US011505925B2

(12) United States Patent
Hu

(10) Patent No.: US 11,505,925 B2
(45) Date of Patent: Nov. 22, 2022

(54) WASHING MACHINE PROVIDED WITH MOVABLE AUXILIARY WASHING UNIT

(71) Applicant: NINGBO JIMU ELECTRICAL APPLIANCE CO., LTD., Zhejiang (CN)

(72) Inventor: Jiebo Hu, Cixi (CN)

(73) Assignee: NINGBO JIMU ELECTRICAL APPLIANCE Co., LTD, Zhejiang (CN)

( * ) Notice: Subject to any disclaimer, the term of this patent is extended or adjusted under 35 U.S.C. 154(b) by 321 days.

(21) Appl. No.: 16/636,024

(22) PCT Filed: Aug. 2, 2018

(86) PCT No.: PCT/CN2018/098366
§ 371 (c)(1),
(2) Date: May 26, 2020

(87) PCT Pub. No.: WO2019/024897
PCT Pub. Date: Feb. 7, 2019

(65) Prior Publication Data

US 2020/0283940 A1 Sep. 10, 2020

(30) Foreign Application Priority Data

Aug. 2, 2017 (CN) ..... 201710650960.6

(51) Int. Cl.

| | |
|---|---|
| ***E03C 1/01*** | (2006.01) |
| ***D06F 1/02*** | (2006.01) |
| ***D06F 3/02*** | (2006.01) |
| ***D06F 39/14*** | (2006.01) |
| ***D06F 49/00*** | (2006.01) |
| ***D06F 39/08*** | (2006.01) |
| *E03C 1/18* | (2006.01) |

(52) U.S. Cl.
CPC ..... *E03C 1/01* (2013.01); *D06F 1/02* (2013.01); *D06F 3/02* (2013.01); *D06F 39/14* (2013.01); *D06F 49/003* (2013.01); *D06F 39/088* (2013.01); *E03C 1/18* (2013.01)

(58) Field of Classification Search
None
See application file for complete search history.

(56) References Cited

U.S. PATENT DOCUMENTS

| | | | | |
|---|---|---|---|---|
| 6,886,371 B2 * | 5/2005 | Arai | D06F 19/00 | 68/3 R |
| 2009/0145174 A1 * | 6/2009 | Kim | D06F 29/005 | 68/27 |
| 2015/0247276 A1 * | 9/2015 | Kim | D06F 37/26 | 68/220 |

* cited by examiner

*Primary Examiner* — Rita P Adhlakha
(74) *Attorney, Agent, or Firm* — Raymond Y. Chan; David and Raymond Patent Firm

(57) ABSTRACT

A washing machine with movable auxiliary washing unit includes: a main washing machine body having an opening and a first main washing space communicated with the opening; and an auxiliary washing unit comprising a doorsets assembly configured over the opening to be pulled out or pushed in for opening or closing the opening, wherein the doorsets assembly further has an auxiliary washing space.

15 Claims, 34 Drawing Sheets

WASHING MACHINE PROVIDED WITH MOVABLE AUXILIARY WASHING UNIT

CROSS REFERENCE OF RELATED APPLICATION

This is a U.S. National Stage under 35 U.S.C. 371 of the International Application Number PCTCN2018/098366, filed Aug. 2, 2018, which claims priority to Chinese application number CN201710650960.6, filed Aug. 2, 2017.

BACKGROUND OF THE PRESENT INVENTION

Field of Invention

The present invention relates to a washing machine, and more particularly to a washing machine having a hand washing unit.

Description of Related Arts

The washing machine is a kind of machine that is electrically powered to do the laundry. The washing machine can be classified into a stirring type, a whirlpool type, or a drum type according to different washing methods. The stirring type washing machine does laundry by rotating an agitator located at a center of a tub to the left and right. The whirlpool type washing machine provides friction force between water flow generated by rotating a pulsator left and right and the laundry to be washed, wherein the pulsator is mounted at the bottom of the rotatable tub and is in shape of a flat plate. The drum type washing machine washes laundries by rotating a drum having a plurality of lifters protruding along an inner surface after water and detergent are put into the drum.

The washing machine can be classified, according to its shape, into a top loader washing machine that laundries are loaded from the top or a front loader washing machine that laundries are loaded from the front. To the top loader washing machine, the laundries can be put into a rotary tub through an opening provided in the top surface. To the front loader washing machine, the laundries can be put into a rotary tub through an opening formed in a front side surface. Generally, the stirring type washing machine and the whirlpool type washing machine are implemented as a top loader washing machine, and a drum type washing machine is implemented as a front loader washing machine.

According to the current technology, such as a washing machine disclosed in Chinese patent publication number CN105189847A, the washing machine is designed with a laundry access opening communicating to a main washing space defined by a stationary tub and a rotary tub, wherein a hand washing or independent washing space unit is arranged above the opening such that a side thereof is pivotally coupled above the opening or detachably arranged above the opening of the washing machine, for manually washing or independently washing the laundry that has hard dirt or small stain thereon in the upper washing space unit before it is putted into the lower main washing space. According to this conventional washing space unit, the water in the upper washing space unit will be poured down into the lower main washing space to be reused by pivotally flipping the upper washing space unit sidewardly or detaching the upper washing space unit from the opening of the washing machine, so as to avoid consuming extra washing water for the hand washing or independent washing work conducted in the upper washing space unit, thereby reducing water consumption.

However, according to the above-mentioned prior Chinese patent publication number CN105189847A, when the laundries in the upper washing space unit require longer time to wash the hard dirt or small stains by hand or to soak longer time to soften the hard dirt or stain but, at the same time, the laundries in the lower main washing space are just finished washing and ready to be taken out for hanging to dry, or that when there are laundries that need to be added into the lower main washing space for washing and thus the upper washing space unit must be flipped to one side pivotally to uncover the opening, in this case, the softening or soaking work in the upper washing space unit must be interrupted and it is difficult to continue the softening or soaking work in the upper washing space unit simultaneously. If the upper washing space unit is pivotally flipped to one side, on one hand, extras work is required to take out the laundries in the upper washing space unit, and on the other hand, the washing water in the upper washing space unit will fall into the lower main washing space while the upper washing space unit is flipped to one side that is conflict to the washing operation in the lower washing space, thereby causing confusion and causing troublesome. Or else, the washing water in the upper washing space unit may need to be drained by a ground pipe from the washing machine that would require to refill the upper washing space unit with new water and cause unnecessary waste of water.

It will be a long felt need to all users to have an innovative washing machine that allows the laundries to be putted into and taken out of the lower main washing space without interrupting the soaking or softening in the upper washing space unit, or without affecting the hand washing operation in the upper washing space unit, while without wasting washing water.

SUMMARY OF THE PRESENT INVENTION

The invention is advantageous in that it provides a washing machine with movable auxiliary washing unit, wherein the washing machine does not interrupt softening or soaking work in an upper auxiliary washing unit while allowing putting laundries into or taking laundries out of the lower first main washing space.

In the present invention, the foregoing and other objects and advantages are attained by a washing machine with an movable auxiliary washing unit, according to a first embodiment adapted to solve the above technical problems, comprising: a main washing machine body having an opening on the top and comprising a first main washing space communicated with the opening, and an auxiliary washing unit, wherein the auxiliary washing unit comprises a doorsets assembly configured over the opening to be driven for opening or closing the opening, wherein the doorsets assembly further comprises a auxiliary washing unit.

According to one embodiment of the present invention, the doorsets assembly comprising the auxiliary washing space is configured to be pulled backward with respect to the main washing machine body in a horizontal direction to open or close the opening of the first main washing space. Optionally, the doorsets assembly is configured to be pulled out or pushed into the left with respect to the main washing machine body to open or close the opening of the main washing space.

In the present invention, the foregoing and other objects and advantages are attained by a washing machine with an movable auxiliary washing unit, according to a second embodiment adapted to solve the above technical problems, comprising: a main washing machine body having an opening on the top and comprising a first main washing space communicated with the opening, and an auxiliary washing unit, wherein the auxiliary washing unit comprises a doorsets assembly configured over the opening to be pivotally rotated relative to the main washing machine body in a horizontal direction to open or close the opening, wherein the doorsets assembly further comprises a auxiliary washing unit.

According to one embodiment of the present invention, the washing machine further comprises a sheltering device comprising an inner cavity to receive part of the doorsets assembly, wherein the doorsets assembly can be completely hidden or partially hidden after the doorsets assembly is moved away from the opening. The sheltering device can be used to store daily necessities such as detergent, making a washing machine more practical.

According to one embodiment of the present invention, preferably the washing machine further comprises a switch control unit controllable connected with the doorsets assembly and arranged on the sheltering device. And the washing machine further comprises a water supply device arranged on the sheltering device.

According to one embodiment of the present invention, the washing machine may has several tubs washing machine to meet the requirements in situation with many people, such as schools.

According to one embodiment of the present invention, the washing machine further comprises a second doorsets assembly configured over an opening of a second tub to be driven for opening or closing the opening. The second doorsets assembly comprises a second auxiliary washing space. Optionally, the washing machine further comprises a second doorsets assembly configured over an opening of a second tub to be pivotally rotated in a horizontal direction for opening or closing the opening. The second doorsets assembly comprises a second auxiliary washing space, so as to provide multiple functional auxiliary washing space.

According to one embodiment of the present invention, the first main washing space may be embodied as a washing unit with washing function or a spin dryer unit with drying function, so as to meet the requirement of different users.

According to one embodiment of the present invention, the main washing machine body further comprises a left wing or/and a right wing beside the doorsets assembly, so that the doorsets assembly is moved more smoothly and reliably.

According to one embodiment of the present invention, the main washing machine body further comprises a slide unit is provided between the doorsets assembly and the left wing, and the doorsets assembly is connected to the left wing through the slide unit. Optionally, the main washing machine body further comprises a slide unit is provided between the doorsets assembly and the right wing, and the doorsets assembly is connected to the right wing through the slide unit.

According to one embodiment of the present invention, the doorsets assembly further comprises a washboard for washing laundries, wherein the washboard is placed on the auxiliary washing space of the doorsets assembly, wherein the washboard is hingedly connected with the doorsets assembly, so that it's easier to do laundry and make laundries cleaner.

According to one embodiment of the present invention, the washing machine further comprises a locking member, wherein when the auxiliary washing unit away from the opening, the main washing machine body is connected with the locking member to the auxiliary washing unit so as to increase safety during operation.

Additional advantages and features of the invention will become apparent in comparison with the conventional art as follows.

One advantage of the invention is to provide a washing machine, wherein since the auxiliary washing unit is directly arranged over the opening of the washing machine and movable in substantially horizontal direction, so that the opening is capable of being opened or closed, so that the washing machine does not interrupt softening or soaking work in the upper auxiliary washing unit while allowing putting laundries into or taking laundries out of the lower first main washing space without affecting hand washing operation inside the upper auxiliary washing unit and wasting washing water. Such arrangement of the present invention also avoids wasting the washing water and the hand washing operation does not require additional washing space that effectively saves working space and time.

Another advantage of the invention is that, during the operation of the washing machine, it is found that for washing and drying laundry once a day, the laundry will be putting into and taking out of the main washing space through the opening of the main washing machine body for one time. That is there are two times for accessing the opening of the main washing space per day. In other words, for each washing and drying laundry operation, the opening is required to be accessed twice for putting the laundries into or taking the laundries out therethrough. However, it takes more time for softening or soaking and hand washing the hard dirt and stain of laundries every day or every time. Accordingly, the present invention provides a doorsets assembly movable in horizontal direction and takes use of a portion of this opening located above the first main washing space for the auxiliary washing unit to rest thereon, wherein the doorsets assembly is provided with a hand washing container which is movable or pivotal to open or close the opening. Therefore, the user can spend more time inside this hand washing container for laundry hand washing and soaking operation to soften hard dirt on the laundries without affecting putting laundries into or taking laundries out of the lower main washing machine. The present invention takes advantage of the position of the opening and use of the space provided on the opening for the first auxiliary washing unit. The present invention is non-obvious and has outstanding substantive subject matters and significant improvement.

Another advantage of the invention is to provide a washing machine, wherein the washing machine according the present invention does not need large area or living space to do the laundry. The washing machine provides the first main washing space at a lower portion for washing laundries and an upper hand washing container for washing faces or brushing teeth, so as to put laundries into or take laundries out of the first main washing space without interrupting softening or soaking work inside the upper hand washing container.

Another advantage of the present invention is that, the washing machine provides a lower first main washing space for doing laundries and an upper hand washing container for face washing or tooth brushing operations as an additional washing sink that avoids the waiting in line condition for a family to use the only one bathroom washing sink for face washing operation or tooth brushing operation in the morning or evening so as to alleviates the pressure using the same washing sink and saves time.

Another advantage of the present invention is that, in comparison with the conventional art, allows the washing machine to wash laundries in a first main washing space while providing an independent hand washing container equipped with independent draining arrangement for discharging dirty water to outside, while ensuring the dirty water formed after the hand washing laundries, face washing and teeth brushing operations in the hand washing container space would not discharging into lower the main washing space.

Another advantage of the present invention is that, in comparison with the background art, while the laundries is putting into or taking out of the lower first main washing space, the washing water in the upper first auxiliary washing unit would not fall into the lower first main washing unit, that prevents from causing confusion and troublesome with the washing operation in the first main washing space, and avoids discharging the washing waster from discharging outside the washing machine to a ground pipeline to prevent a waste of as well as refilling the washing water in the first auxiliary washing unit.

Another advantage of the present invention is that, one washing machine of the present invention can be simultaneously provided to be operated by two users. That is, one user allows performing softening, soaking, washing laundries or washing face in the first auxiliary washing unit while another user allows operations of putting laundries into, putting detergent into or taking laundries out of the first main washing space without interfering with each other, and thus improving working efficiency.

Another advantage of the present invention is that, to tenant with unstable work and dweller with smaller living space, as long as the user owns a washing machine with hand washing container of the present invention, he or she seems substantially having another hand washing container for washing laundry, face washing, or teeth brushing operation without the need to purchase another bath washing sink that significantly saves his or her living space to place the sink and purchasing expense of the sink.

In addition, the first auxiliary washing unit can be independent from the normal washing method and thus improving the washing efficiency.

In addition, since the main washing machine body and the auxiliary washing unit are coupled by the locking member, when the laundries need to be put into the first main washing space, the user can conveniently open the doorsets assembly and keep the doorsets assembly remained in position by the locking member. When auxiliary washing is needed, the user can release the locking member and move the auxiliary washing unit to be in position.

Still further objects and advantages will become apparent from a consideration of the ensuing description and drawings. These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
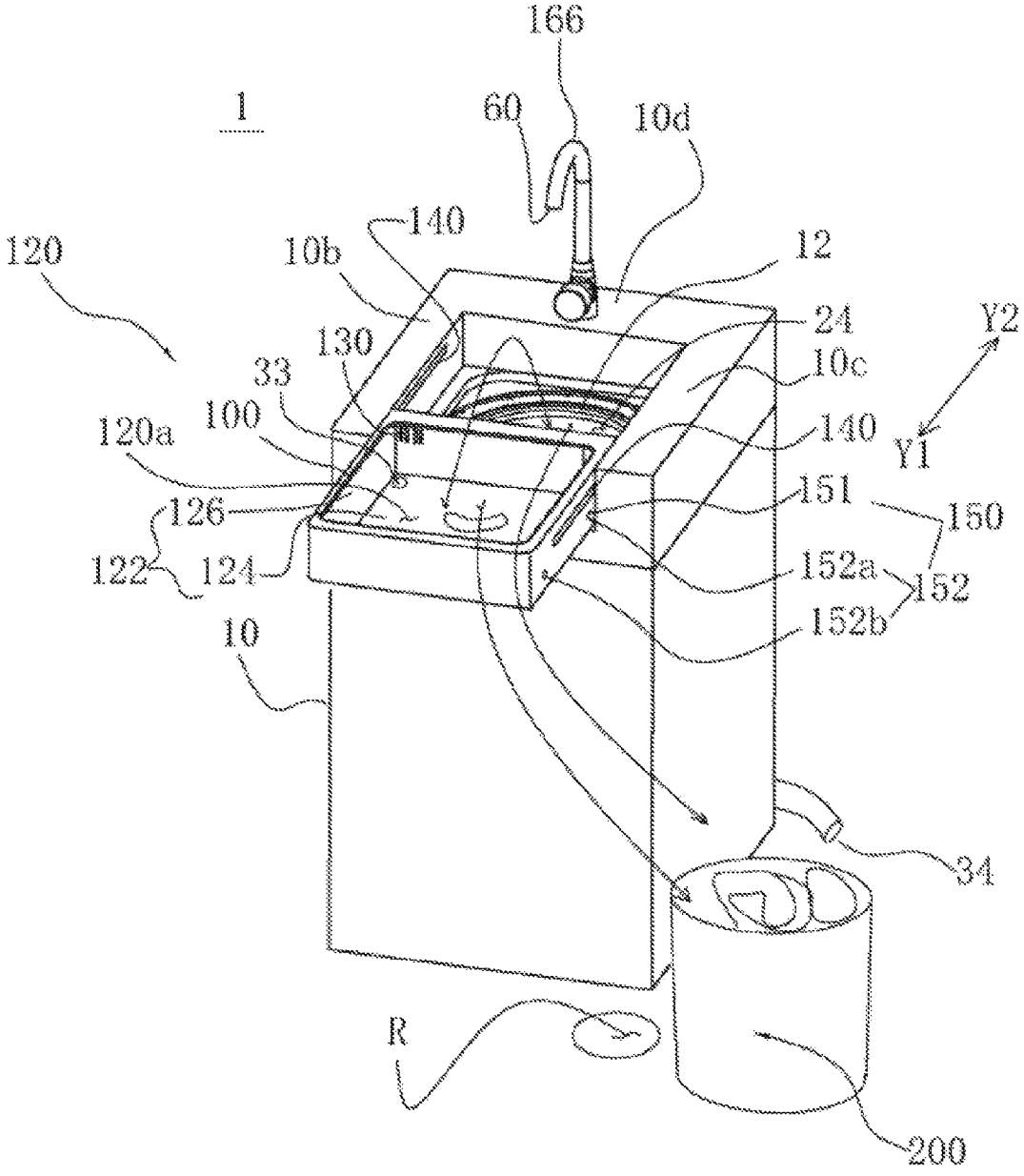
FIG. 1 is a perspective view of a washing machine according to a first preferred embodiment of the present invention.
Figure 2:
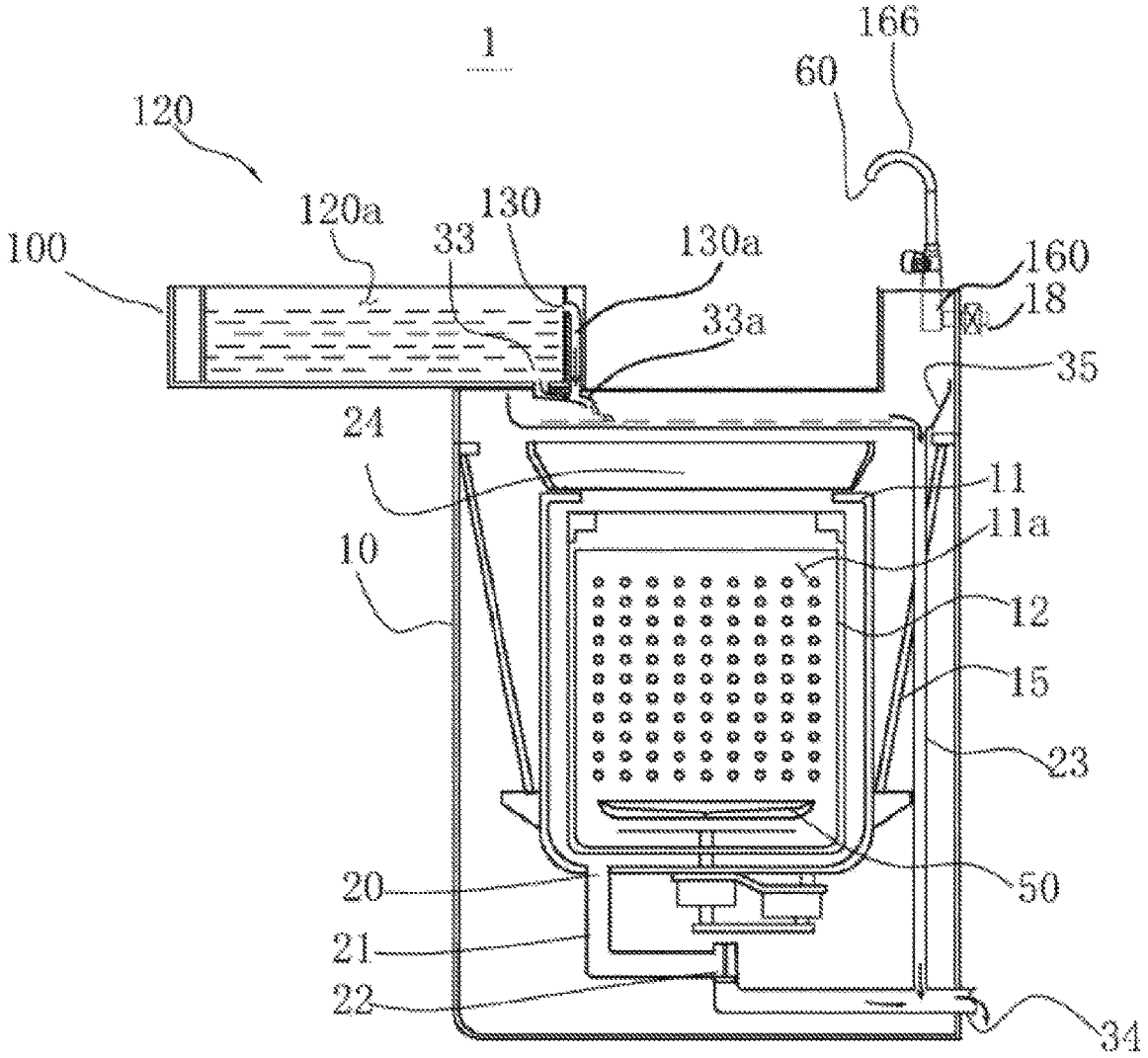
FIG. 2 is a sectional view of the washing machine according to a first and a second preferred embodiment of the present invention, illustrating drainage arrangement when the doorsets assembly and the opening are in an opened state.
Figure 3:
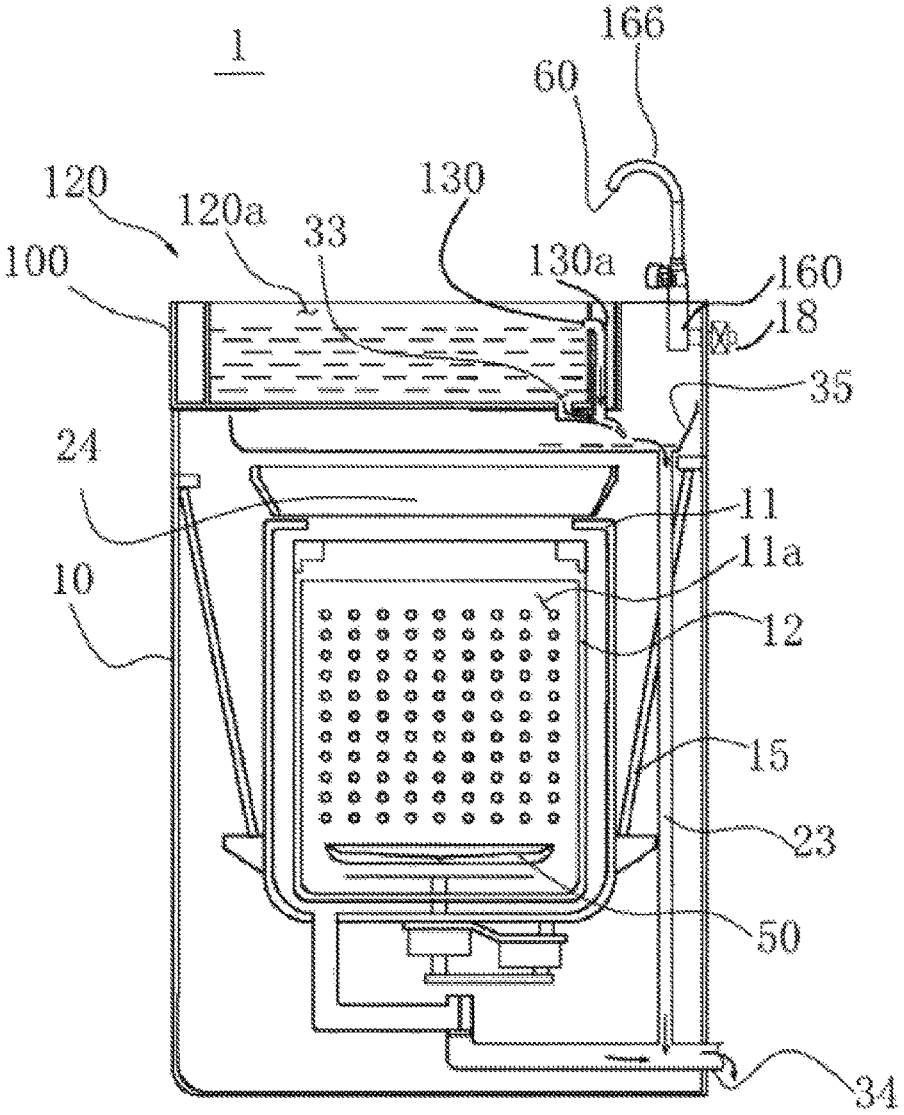
FIG. 3 is a sectional view of the washing machine according to a first and a second preferred embodiment of the present invention, illustrating drainage arrangement when the doorsets assembly and the opening are in a closed state.

Referring to FIG. 1 to FIG. 3, a washing machine 1 according to a first preferred embodiment of the present invention comprises a main washing machine body 10 providing a housing of the washing machine 1, a suspension device 15, a stationary tub 11 supported in the main washing machine body 10 by means of the suspension device 15 and configured for receiving washing water therein, a rotary tub 12 rotatably arranged within the stationary tub 11 to define a first main washing space 11*a* therein, and a pulsator 50 arranged in the rotary tub 12 for generating water flow in the rotary tub 12.

The main washing machine body 10 has a opening 24 formed on a top of the main washing machine body 10, wherein the opening 24 is communicated with the first main washing space 11*a* of the washing machine 1 for putting laundries into the rotary tub 12 through the opening 24. The main washing machine body further comprises a doorsets assembly 100 mounted on the top to open or close the opening 24.

The washing machine further comprises an auxiliary washing unit 120 comprising the doorsets assembly 100. It can also be appreciated that the auxiliary washing unit 120 has the function as a doorsets assembly. The auxiliary washing unit 120 is configured over the opening 24 and movable in substantially horizontal direction to achieve the purpose of opening or closing the opening.

The above-mentioned doorsets assembly 100 has recess to form an auxiliary washing space 120*a* defined as a hand washing container, and the hand washing container can be used for softening hard stain, soaking work, washing laundries or washing faces.

The washing machine according the present invention is preferably provided with a left wing 10*b* and a right wing 10*c* on the top of the main washing machine body 10, wherein the doorsets assembly 100 may be connected to the slide unit 140 to the left wing 10*b*, or the doorsets assembly 100 may be connected to the slide unit 140 to the right wing 10*c*, or the doorsets assembly 100 is respectively connected to the left wing 10*b* and the right wing 10*c* both by the rail unit 140, so that the doorsets assembly 100 can move horizontally or slide approximately horizontally.

Optionally, the shape and height of the left wing 10*b* and/or the right wing 10*c* are arranged as needed, and the shape and arrangement are not limited.

The position illustrated as R in FIG. 1 is the position where the user stands. When the doorsets assembly 100 of the washing machine door is moved along the Y1 direction, the opening 24 is gradually opened to expose. The laundry to be washed can be put into the rotary tub 12 through the opening 24 or the washed laundry can be taken out of the rotary tub 12 through the opening 24. The doorsets assembly 100 is moved horizontally along the Y2 direction, and the opening 24 is gradually closed. It is appreaciated that the operation of putting laundries into or taking laundries out of the rotary tub 12 through the opening 24 will not interrupt and affect the work of softening and soaking the laundries in the hand washing container, and will not waste washing water.

The above-mentioned washing machine can achieve synergies of user's space requirements of different kinds of laundries operation inside the laundry basket 200, the first main washing space 11*a*, and the hand washing container 120*a*.

Therefore, the washing machine provides available coordination functions for users to achieve efficient washing, save time and reduce operation intensity.

Optionally, the doorsets assembly 100 is surrounded in three sides by a left wing 10*b*, a rear wing 10*d*, and a right wing 10*c*.

The auxiliary washing unit 120 is connected to the slide unit 140 to the left wing 10*b* so as to be pulled from one side thereof to realize the horizontal movement of the auxiliary washing unit 120.

Optionally, the shape and height of the left wing 10*b* or/and the rear wing 10*d* or/and the right wing 10*c* are designed as required, and the shape and arrangement are not limited.

Optionally, the doorsets assembly 100 as the auxiliary washing unit 120 further comprises an pulley (not shown) provided between the bottom surface and the components around the opening, so that the pulling movement is easier when the auxiliary washing space 120*a* has more weight and is filled with water and laundries and the hand feeling is better when the doorsets assembly 100 is pulled and moved.

The slide unit 140 is selectively disposed between the bottom surface of the doorsets assembly 100 and the components around the opening on the main washing machine body 10.

Optionally, the doorsets assembly 100 further comprises a buffer member which can prevent the doorsets assembly 100 from being impacted and damaged when the pulled or pushed movement is in place, and prevent the hand washing container or the main washing machine body 10 from being damaged or generating noise.

Optionally, the doorsets assembly 100 further comprises a switch member (not shown) provided to control a power supply circuit of the washing operation of the first main washing space of the washing machine when the doorsets assembly 100 is in the position wherein the doorsets assembly 100 is moved to close the opening 24, the power supply circuit of the washing operation of the first main washing space is changed to a connected state, and when the doorsets assembly 100 is moved to open the opening 24, the power supply circuit of the washing operation of the first main washing space is turned off to ensure the safety of operation.

Optionally, the first auxiliary washing unit 120 may be made of thermoplastic resin. The components of the first auxiliary washing unit 120 may be made of acrylonitrile-butadiene-styrene (ABS) material or ceramic material or pottery, or stainless steel made by molding as required. However, the present invention is not limited in materials, and the first auxiliary washing unit 120 may be made of any material having sufficient impact resistance and rigidity for hand washing.

Optionally, an outer side surface (ie, the outer surface layer) of the auxiliary washing unit 120 is made of a thermoplastic resin, so that components such as the slide unit 140 can be easily concealed, or be firmly connected as required. The molding process is less costly and easier to manufacture with selected thermoplastic resin.

Optionally, in order to increase the safety of operation, the auxiliary washing unit 120 is locked by a locking member 150 between the main washing machine body 1 and the auxiliary washing unit 120 in a state where the horizontal movement away or over the opening 24, as shown in FIG. 1. The locking member 150 comprises a limiting projection 151 and a limiting slot 152. The limiting projection is provided on the left wing 10*b* or/and the right wing 10*c*. The locking member 150 further comprises a spring (not shown) is extended from an inner end of the limiting projection 151, so that the outer end of the limiting projection 151 has a trend of being inserted into the limiting slot 152. Corresponding to one of the limiting projection, there are two limiting slots separated, which are located near the two ends of the auxiliary washing unit, wherein when the limiting projection is inside the first limiting slot 152*a*, the opening is in an opened state, wherein when the limiting projection is inside the second limiting slot 152*b*, the opening is in a closed state. When the auxiliary washing unit 120 is moved horizontally away from the opening 24 to be in the opened state, as shown in FIG. 1, the limiting projection 151 is entered into the first limiting slot 152*a*, so that the auxiliary washing unit 120 is reliably positioned at the position of exposing the opening. When it is not necessary to putting laundries into or taking laundries out of the first main washing space 11*a*, release the coupling of the locking member. At this time, if the auxiliary washing unit 120 is pushed inwardly, the spring will be compressed, and the limiting projection is dropped out of the first limiting slot 152*a*. In other words, when the locking member 150 is unlocked, the auxiliary washing unit 120 is movable. After the auxiliary washing unit 120 is pushed into position, the limiting projection 151 can just be aligned with the second limiting slot 152*b*. With the spring restoring force, the outer end of the limiting projection 151 is inserted into the second limiting slot 152*b* for locking.

It is appreciated that with the above-mentioned locking member, the user can conveniently open and close the opening by the doorsets assembly 100 with increased the safety and stability. Optionally, the above-mentioned locking member is not limited to the structure enabled as two limiting slot and one limiting projection. It is also enable to be embodied as one limiting slot and two limiting projection.

Optionally, the main washing machine body 10 further comprises a front wing located on the front side of the auxiliary washing unit, or/and a rear wing located on the rear side of the auxiliary washing unit, or/and a left wing located on the left side of the auxiliary washing unit, or/and a right wing located on the right side of the auxiliary washing unit. The locking member 150 is embodied between the doorsets assembly 100 and a front wing 10*a*/the left wing 10*b*/the right wing 10*c* of the main washing machine body.

Optionally, the shape and height of the front wing 10*a* or/and the left wing 10*b* or/and the rear wing (10*d*) or/and the right wing 10*c* are designed as required, and the shape and arrangement are not limited.

Figure 18:
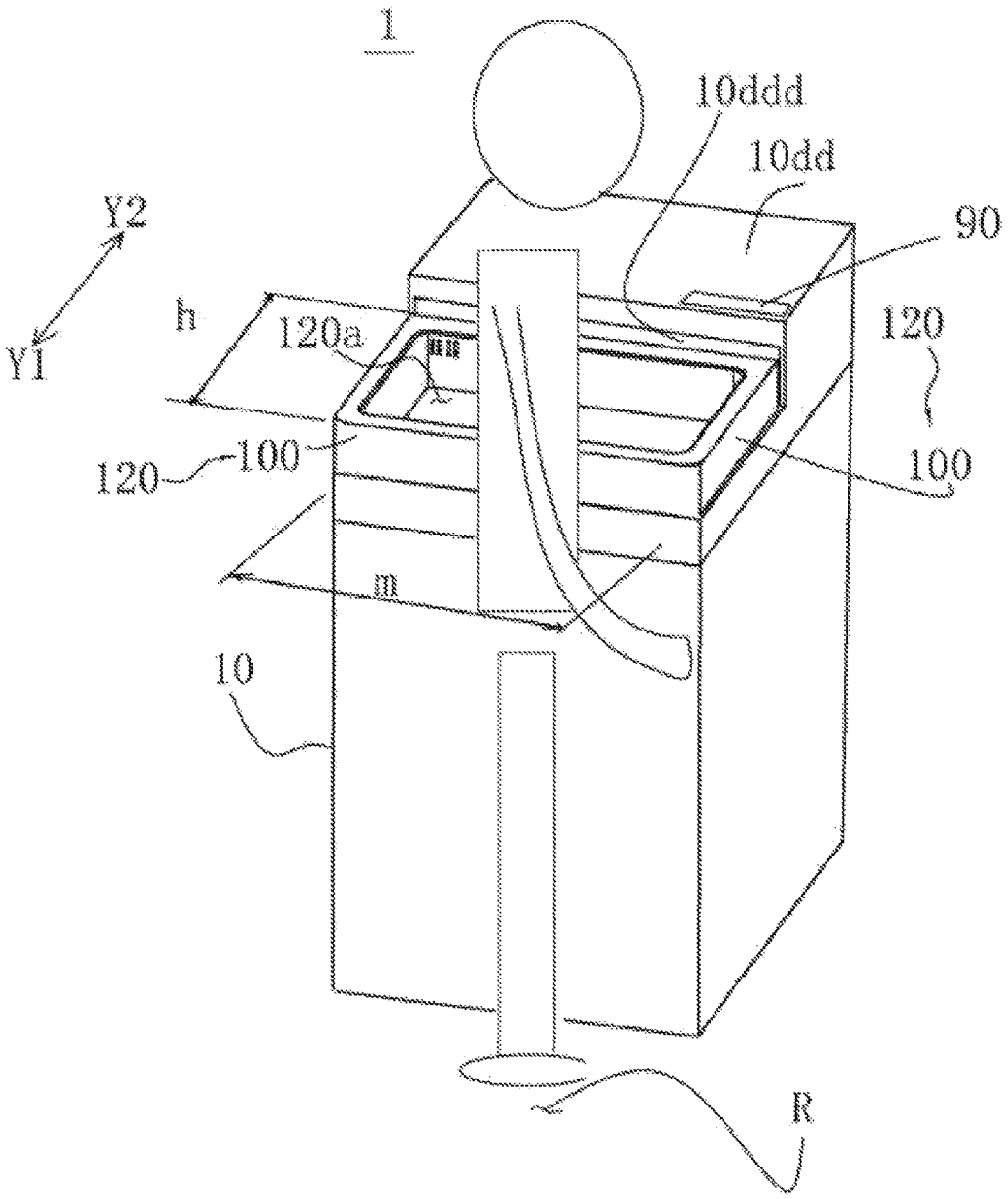
FIGS. 18, 19, 20, 21 and 22 are perspective views of the washing machine according to a tenth preferred embodiment of the present invention, illustrating the auxiliary washing unit in different alternative modes.

Optionally: the washing machine further comprises an automatic auxiliary device (not shown), in which the mechanical movement of the doorsets assembly 100 of opening or closing can automatically control by a switch control unit 90 (as shown in FIG. 18).

The auxiliary washing space 120*a* comprises a unit body 122 comprising a bottom portion 124 and a side portion 126.

The bottom portion 124 as a factor determining the depth of the auxiliary washing space 120*a* may be provided as a flat or curved structure. Optionally, the side portion 126 may be formed to be inclined toward the bottom portion 124.

The bottom portion 124 and the side 126 are formed a recessed auxiliary washing space, so that separate washing can be operated when the washing water is in the auxiliary washing space 120*a*.

The hand washing container 120*a* further comprises one or more frictional protrusions (not shown in drawings) protruded on the unit body 122*a* to promote assistance for washing. Specifically, the one or more friction protrusions may be protruded from the side portion 126*a*, or protruded from at any position on the inner surface of the hand washing container 120*a*. The one or more friction protrusions increase the friction force between the laundries during hand washing, so that the dirt and stains are easily washed off the laundries. However, the shape and arrangement of the friction protrusion are not limited in the present invention.

The first hand washing unit 120 (hand washing container 120*a*) comprises an external water supply valve 18. A water supply pipe (not shown in drawings) for supplying washing water into the stationary tub 11 is mounted in an upper portion of the stationary tub 11, wherein one end of the water supply pipe is configured to be connected with the external water supply valve 18. Preferably, the other end of the water supply pipe is connected with a detergent supply device. The washing water supplied through the water supply pipe is injected into the stationary tub 11 together with the detergent from a detergent supply unit (not shown in drawings).

The stationary tub 11 has a drain outlet 20 formed at a bottom of the stationary tub 11 for discharging washing water received therein, and comprises a first drain pipe 21 connected to the drain outlet 20. The stationary tub 11 further comprises a drain valve 22 mounted on the first drain pipe 21 to control drainage of washing water. An outlet of the drain valve 22 may be connected with a second drain pipe 34 for discharging washing water to outside.

According to FIGS. 1, 2 and 3, the auxiliary washing unit 120 has an auxiliary washing space in which hand washing can be performed separately and independently. The first main washing space 11*a* and the hand washing container 120*a* are separated and independent from each other, so that washing can be performed in the first main washing space 11*a* and the hand washing container 120*a* independently. In addition, the washing in the first main washing space 11*a* and the hand washing container 120*a* may be operated separately or simultaneously.

As shown in FIGS. 1-3, according to the first embodiment of the present invention, the washing machine 1 comprises a water supply device 160 and a water supply valve 18, wherein the water supply device 160 is arranged for supplying water to the first main washing space 11*a* and the auxiliary washing space 120*a*.

The water supply device 160 of the hand washing container 120*a* comprises an auxiliary water supply pipe or faucet 166*a* having an auxiliary water supply outlet 60 provided at one side of the hand washing container 120*a* to supply washing water through the auxiliary water supply pipe 166*a* into the hand washing container 120*a* for laundry washing or hand washing.

Preferably, the e washing machine according the present invention further comprises a water heating unit to provide hot water to the water supply outlet 60 to obtain hot water in the auxiliary washing space 120*a*. The water heating unit may be mounted in the water supply device 160.

This application does not increase the floor space of the washing machine 1 and does not occupy much of the user's living space, and provides multiple washing spaces. The washing machine allows the lower first main washing space 11*a* to do the laundries and provides an upper washing operation for face washing or teeth brushing in the upper hand washing container.

Compared with the prior art, the face washing operation or teeth brushing operation in the hand washing container is allowable without interrupting the washing work in the lower main washing space.

Hereinafter, a washing machine according a second embodiment of the present invention is illustrated, wherein those components and configurations having same structure as the above first preferred embodiment are not repeatedly described in the following.

FIG. 2 is a sectional view of the washing machine according to the second preferred embodiment of the present invention, illustrating drainage arrangement when the doorsets assembly 100 and the opening are in an opened state.

FIG. 3 is a sectional view of the washing machine according to the second preferred embodiment of the present invention, illustrating drainage arrangement when the doorsets assembly 100 and the opening are in a closed state.

The hand washing container 120*a* further has an auxiliary drain outlet 33 provided at the bottom portion 124 thereof for discharging the washing water contained in the hand washing container 120*a*. The auxiliary drain outlet 33 may be embodied as a hole formed in the bottom portion 124 of the hand washing container 120*a*, or may be embodied as an individual switch member.

The hand washing container 120*a* further has an overflow opening 130 formed at an upper position of the side portion 126 so that the overflowing washing water in the hand washing container 120*a* can be discharged therethrough when it is overfull preventing water contained in the hand washing container 120*a* from overflowing from the top edge of the side portion 126.

The main washing machine body further comprises a receiving tank 35 for the water from the auxiliary drainage outlet 33 and the overflow opening 130 flows into the receiving tank 35 in a predetermined length which whatever the doorsets assembly 100 is moved, the downstream water is always flowed into the receiving tank 35 And, an auxiliary drainage pipe 33*a* provided at the bottom portion 124*a* thereof is driven to move within the length of the receiving tank 35. And the water in the receiving tank 35 is discharged into a third drainage pipe 23 arranged in the main washing machine body, wherein the third drainage pipe 23 is communicated with the second drainage pipe 34 to discharge the washing water to the outside.

In the present invention, the third drainage pipe 23 may also preferably be configured to directly and individually discharge to the outside.

Hereinafter, a washing machine according a third embodiment of the present invention is illustrated, wherein those components and configurations having same structure as the above first and second preferred embodiment are not repeatedly described in the following.

Figure 4:
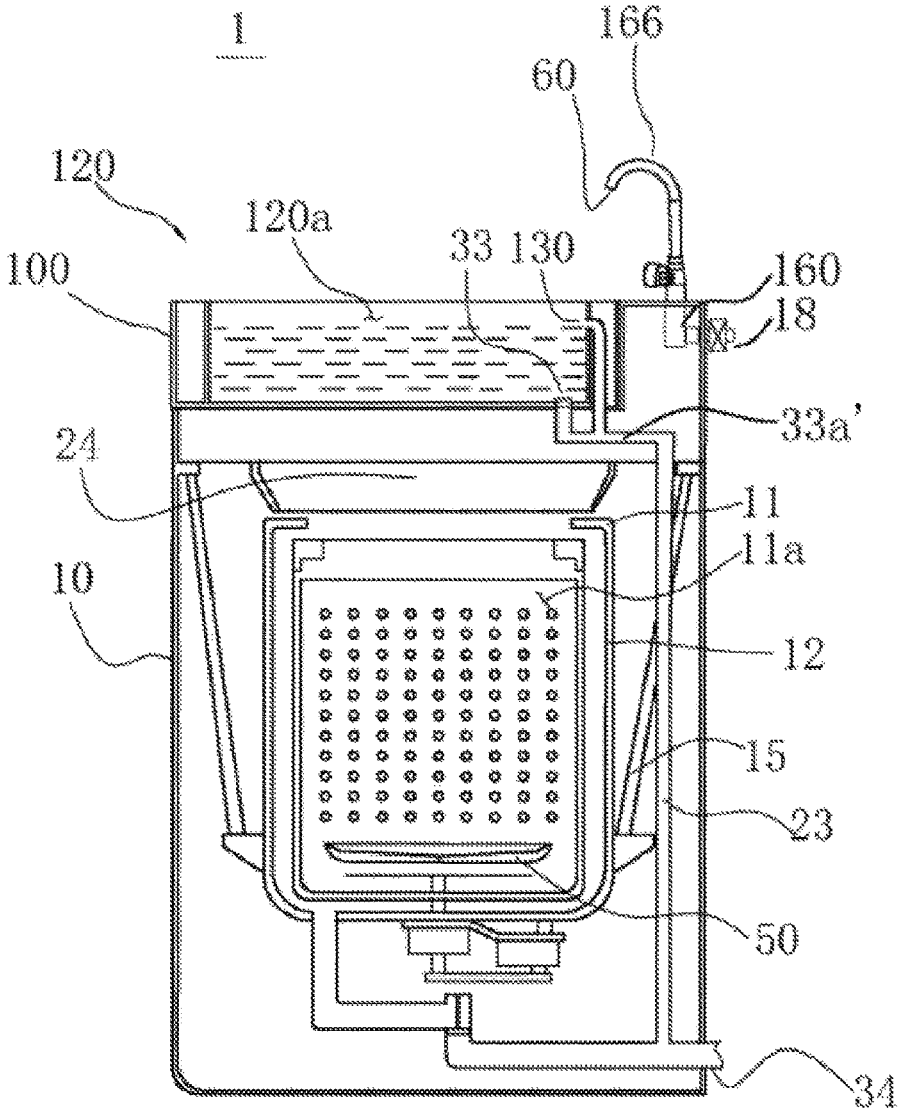
FIG. 4 is a sectional view of the washing machine according to a third preferred embodiment of the present invention, illustrating an alternative drainage arrangement when the doorsets assembly and the opening are in an opened state.
Figure 5:
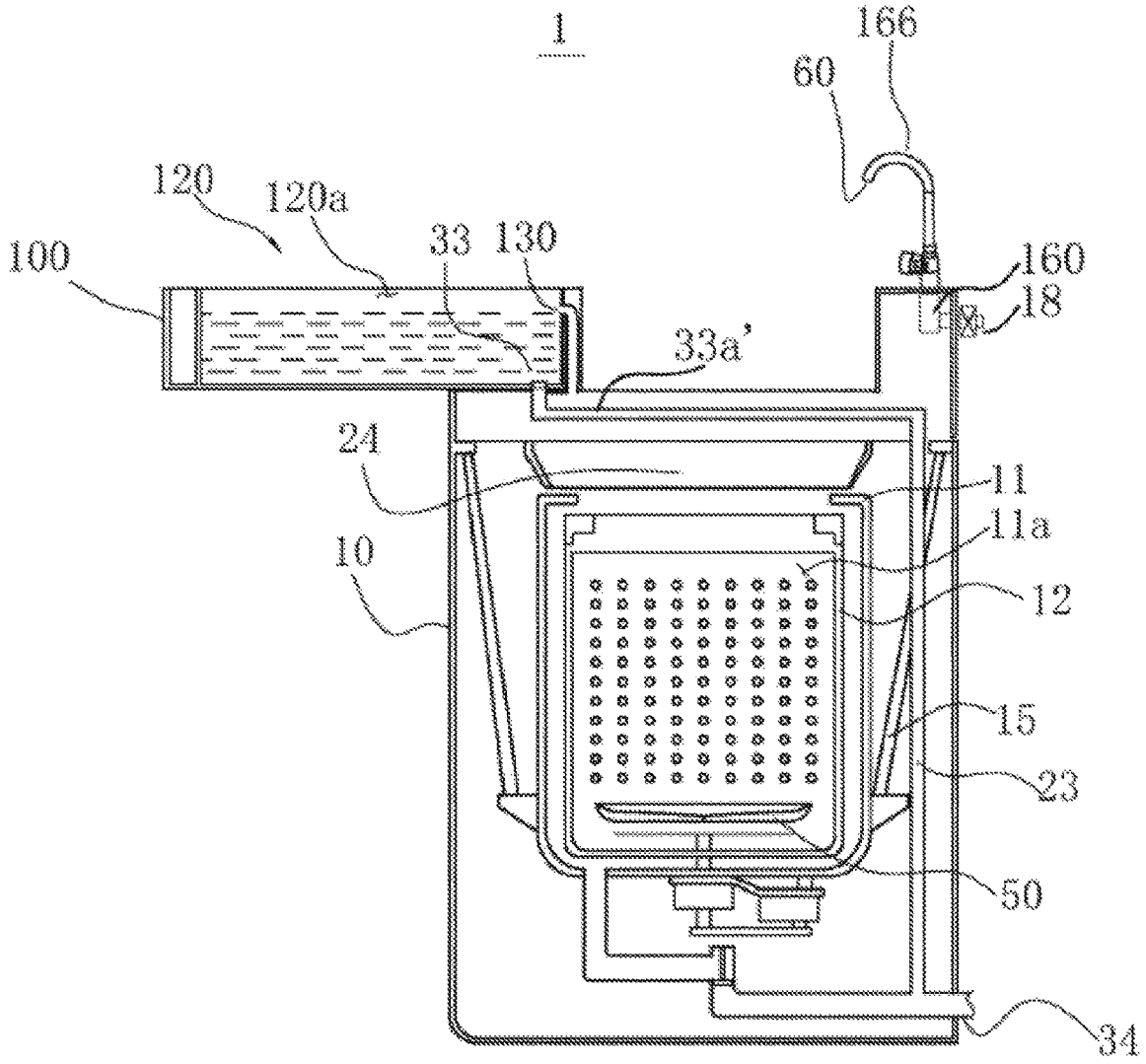
FIG. 5 is a sectional view of the washing machine according to the third preferred embodiment of the present invention, illustrating drainage arrangement when the doorsets assembly is in a closed state.

According to the opened state of the doorsets assembly 100 of the washing machine is shown in FIG. 4, and the closed state where the doorsets assembly 100 of the washing machine is shown in FIG. 5.

Different from the second embodiment, no receiving tank 35 is provided. The main washing machine body 10 further comprises a movable connection unit 33*a*', wherein the water discharged from the auxiliary drainage outlet 33 and the overflow opening 130 flows into the third drainage pipe 23 through the movable connection unit 33*a*' to the third drainage pipe 23 communicated with the second drain pipe 34 for discharging the washing water to the outside.

According to the embodiment, the movable connection unit 33*a*' is connected to the auxiliary drainage outlet 33 and the overflow opening 130 on the one end, and connected to the third drainage pipe 23 on the other end. The movable connection unit 33*a*' has a predetermined length which when the doorsets assembly 100 is moved, the movable connection unit 33*a*' is driven to move with the doorsets assembly 100.

The water overflowed from the overflow opening 130 According to the embodiment passes through the movable connection unit 33*a*', the third drainage pipe 23, and the second drainage pipe 34 in order and is discharged to the outside by the second drainage pipe 34. However, the third drainage pipe 23 may also preferably be configured to directly and individually discharge to the outside.

Hereinafter, a washing machine according a fourth embodiment of the present invention is illustrated, wherein those components and configurations having same structure as the above first, second and third preferred embodiment are not repeatedly described in the following.

Figure 6:
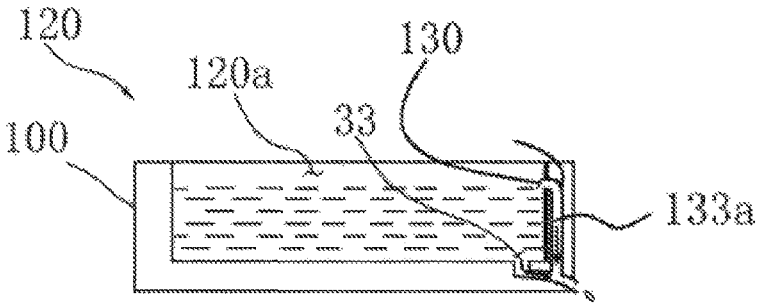
FIGS. 6 and 7 are sectional views of the washing machine according to a fourth preferred embodiment of the present invention, illustrating drainage arrangement in double layers.
Figure 7:
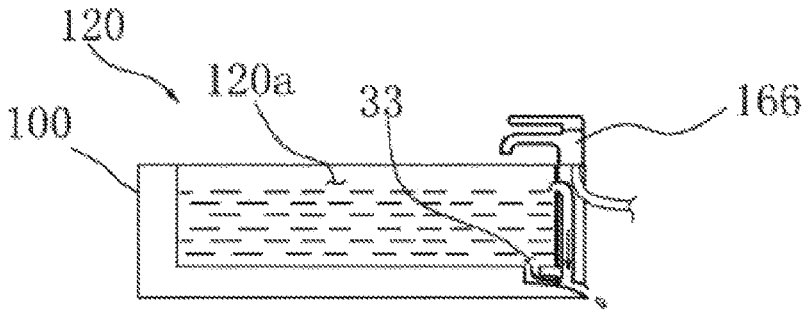

FIGS. 6 and 7 are sectional views showing a double-layer of a doorsets assembly of a washing machine according to a fourth embodiment of the present invention. Optionally, the inner layer containing washing water is made of ceramic, or stainless steel, and the outer layer is formed by heated plastic resin, and the doorsets assembly 100 is connected to the main washing machine body to maintain a high temperature for a longer time to the water in the auxiliary washing space 120*a*. The water supply device 160 is directly connected to the doorsets assembly 100.

Hereinafter, a washing machine according to a fifth embodiment of the present invention is illustrated, wherein those components and configurations having same structure as the above first, second, third and fourth preferred embodiment are not repeatedly described in the following.

Figure 8:
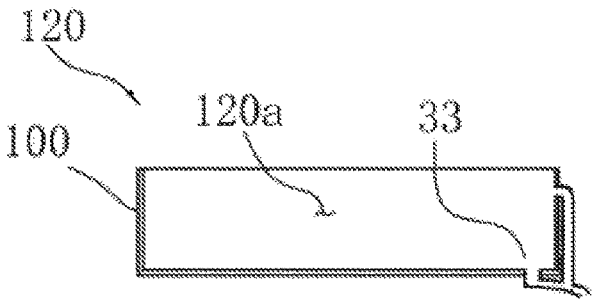
FIGS. 8 and 9 are sectional views of the washing machine according to a fifth preferred embodiment of the present invention, illustrating drainage arrangement in single layer.
Figure 9:
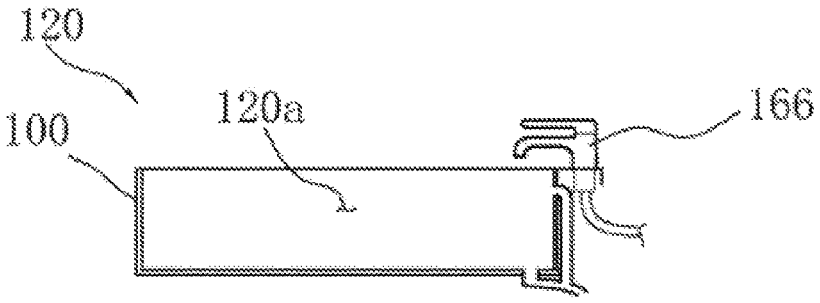

FIGS. 8 and 9 are sectional views showing a single-layer of a doorsets assembly of a washing machine according to a fifth embodiment of the present invention. Optionally, the hand washing container containing washing water made of ceramic, or stainless steel.

Hereinafter, a washing machine according to a sixth embodiment of the present invention is illustrated, wherein those components and configurations having same structure as the above first, second, third, fourth and fifths preferred embodiment are not repeatedly described in the following.

Figure 10:
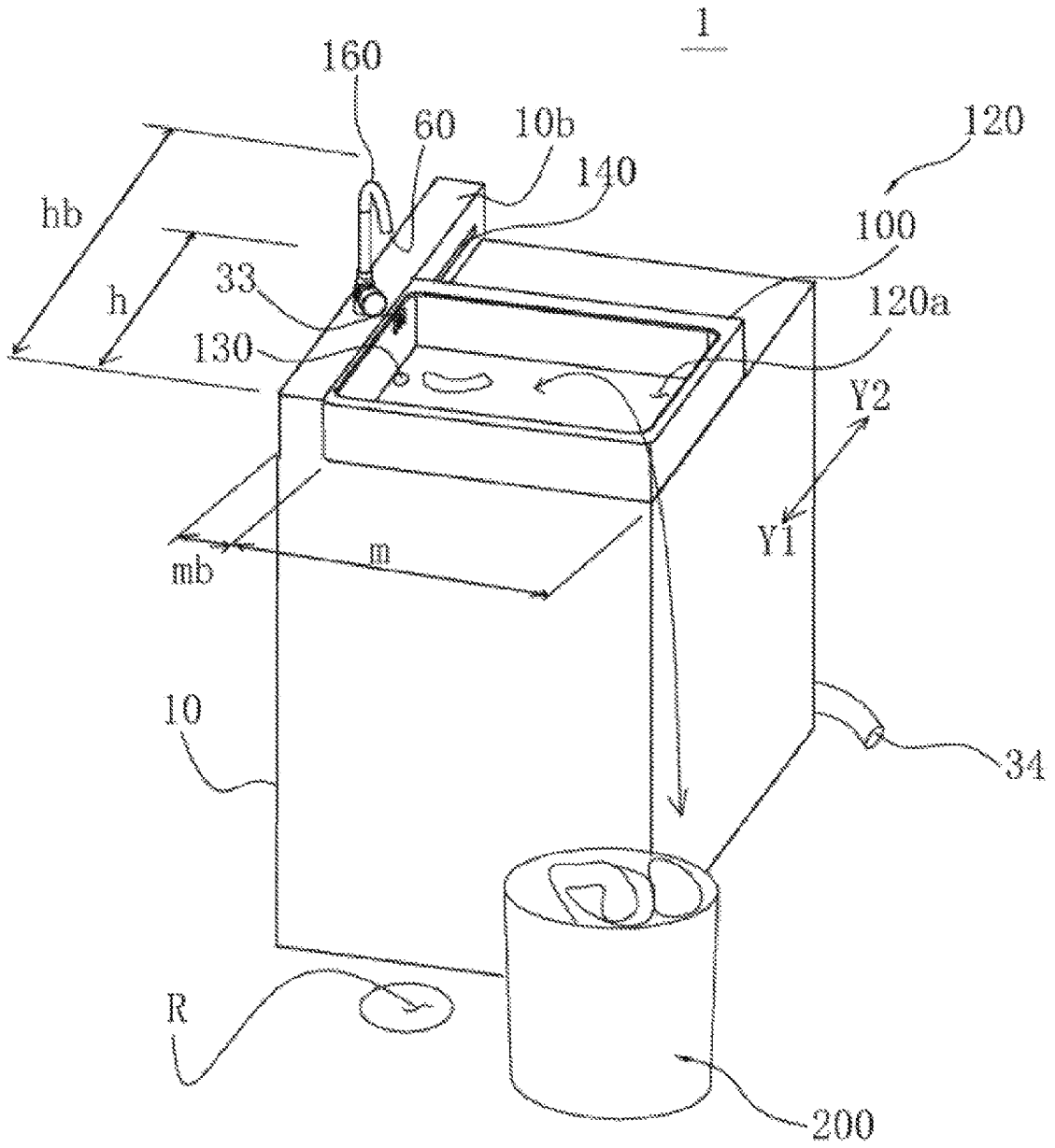
FIGS. 10 and 11 are perspective views of the washing machine according to a sixth preferred embodiment of the present invention, illustrating the auxiliary washing unit in different alternative modes.
Figure 11:
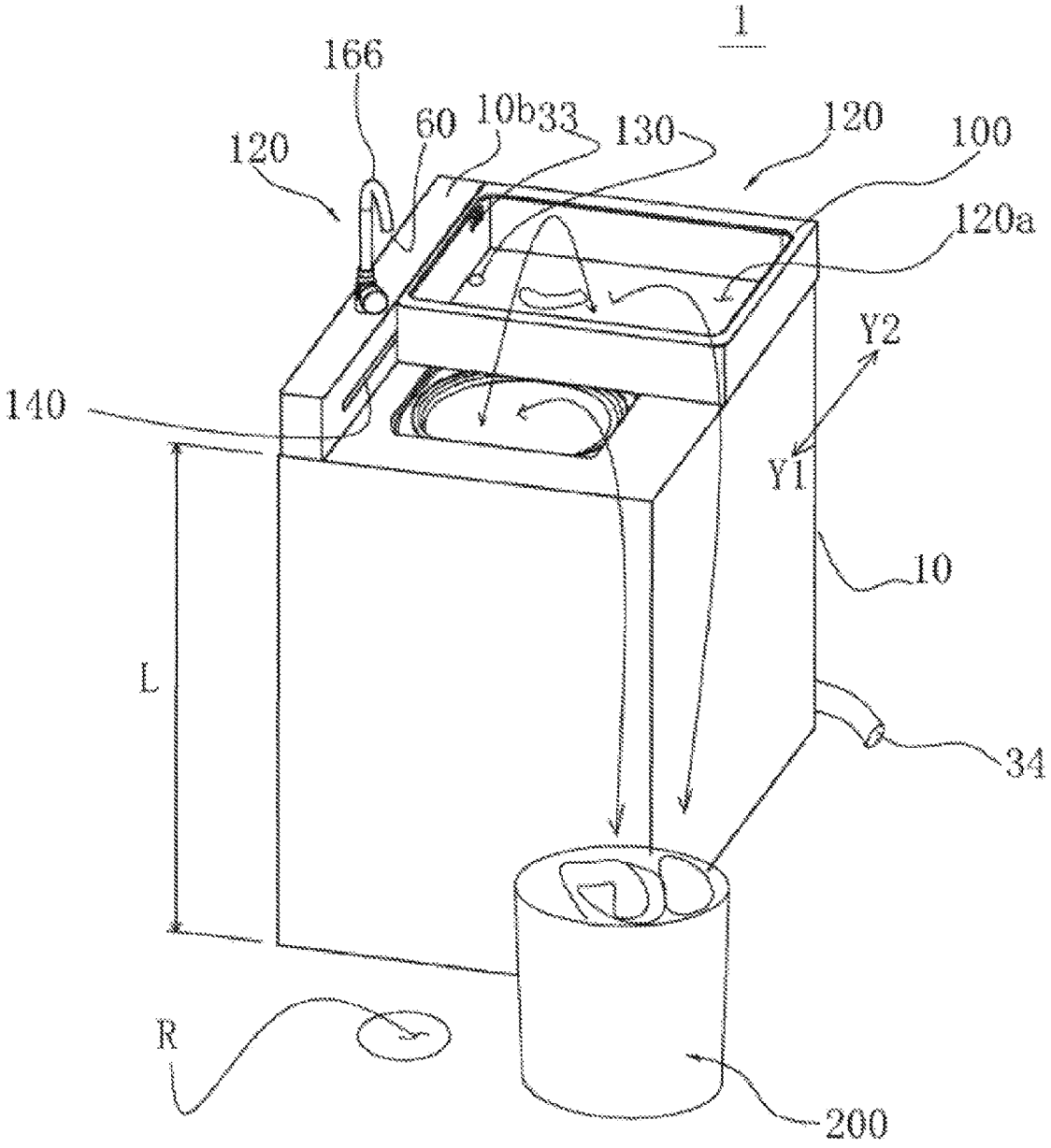

FIGS. 10 and 11 are perspective views of different states of the auxiliary washing unit 120 of the washing machine according to the sixth embodiment of the invention. FIG. 10 is a perspective view of the closed state of the doorsets assembly 100 of the washing machine. FIG. 11 is a perspective view of the opened state of the doorsets assembly 100 of the washing machine.

Optionally, the doorsets assembly 100 is arranged adjacent to the left wing 10*b*. The left wing 10*b* has a length named as hb and a width as mb, and the doorsets assembly 100 has a length named as h and a width as m, as shown in FIG. 10. Compared with the doorsets assembly 100 in the first embodiment, a larger internal auxiliary washing space 120*a* is formed, so as to provide more widely space to users, such as, to put more laundries once for auxiliary washing.

According to the embodiment, the washing machine comprises the left wing 10*b* and the slide unit 140 mounted on the left wing 10*b* for connecting to the doorsets assembly 100. The doorsets assembly 100 is connected to the left wing 10*b* by the slide unit 140, so that one side of the doorsets assembly 100 is movable along the left wing 10*b*.

Optionally, the shape and arrangement height of the left wing 10*b* are predetermined as needed, and the shape and arrangement are not limited.

The positions illustrated as R in FIGS. 10 and 11 are the position where the user stands. When the doorsets assembly 100 is slide to move along the direction of Y1, the opening 24 is gradually closed, and the auxiliary washing space 120*a* can be used for softening or soaking work or manually washing laundries or washing faces.

When the doorsets assembly 100 is slide to move along the direction of Y2, the opening 24 is gradually opened, and the laundry to be washed can be put into the rotary tub 12 through the opening 24. The washing machine 1 according to the present invention can achieve synergies of user's space requirements for laundries inside the laundry basket 200, laundries in the rotary tub 12, and laundries in auxiliary washing space 120*a*.

Another advantage of the embodiment is to provide a washing machine, wherein when the doorsets assembly 100 is moved along the Y1 direction, the height of the washing machine body (for example, the height of the washing machine is 100 cm) is designed to be suitable for the user to reach into the auxiliary washing space for softening hard stain soaking work or manual washing laundries or washing faces without bending over too much for a taller user to use the auxiliary washing space 120*a*, wherein when the doorsets assembly 100 is moved along the Y2 direction, the height of the washing machine (for example, the height of the washing machine is 100 cm) is 80 cm of height L with reduced the height L1 of the doorsets assembly 100 (for example, the size of L1 is 20 cm) to be easily taken laundries from the bottom of the rotary tub 12 without requiring the user to have a taller body or a longer arm.

Optionally, the doorsets assembly 100 further comprises an pulley (not shown) provided on the bottom surface against the components around the opening, so as to decrease friction between the auxiliary washing space 120*a* and the lower body while the weight of the water and laundries in the auxiliary washing space 120*a* is on the pulley, so that the pulling movement is easier when the auxiliary washing space 120*a* has more weight and is filled with water and laundries and the hand feeling is better when the doorsets assembly 100 is pulled and moved.

The slide unit 140 may also be preferably disposed between the bottom surface of the doorsets assembly 100 and the components around the opening on the main washing machine body 10.

Hereinafter, a washing machine according to a seventh embodiment of the present invention is illustrated, wherein those components and configurations having same structure as the above first, second, third, fourth, fifth, and sixth preferred embodiment are not repeatedly described in the following.

Figure 12:
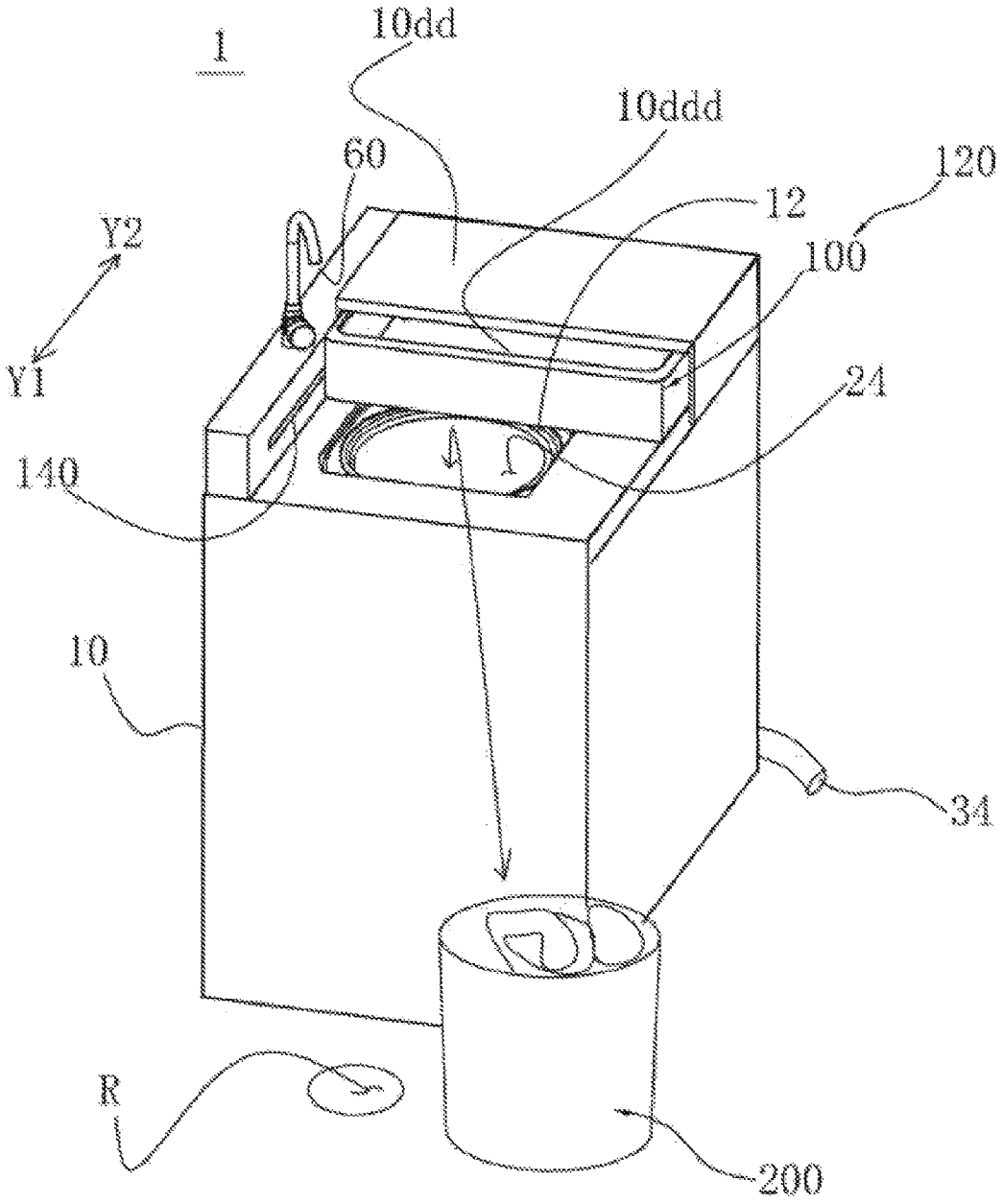
FIGS. 12 and 13 are perspective views of the washing machine with a sheltering device according to a seventh preferred embodiment of the present invention, illustrating the auxiliary washing unit in different alternative modes.
Figure 13:
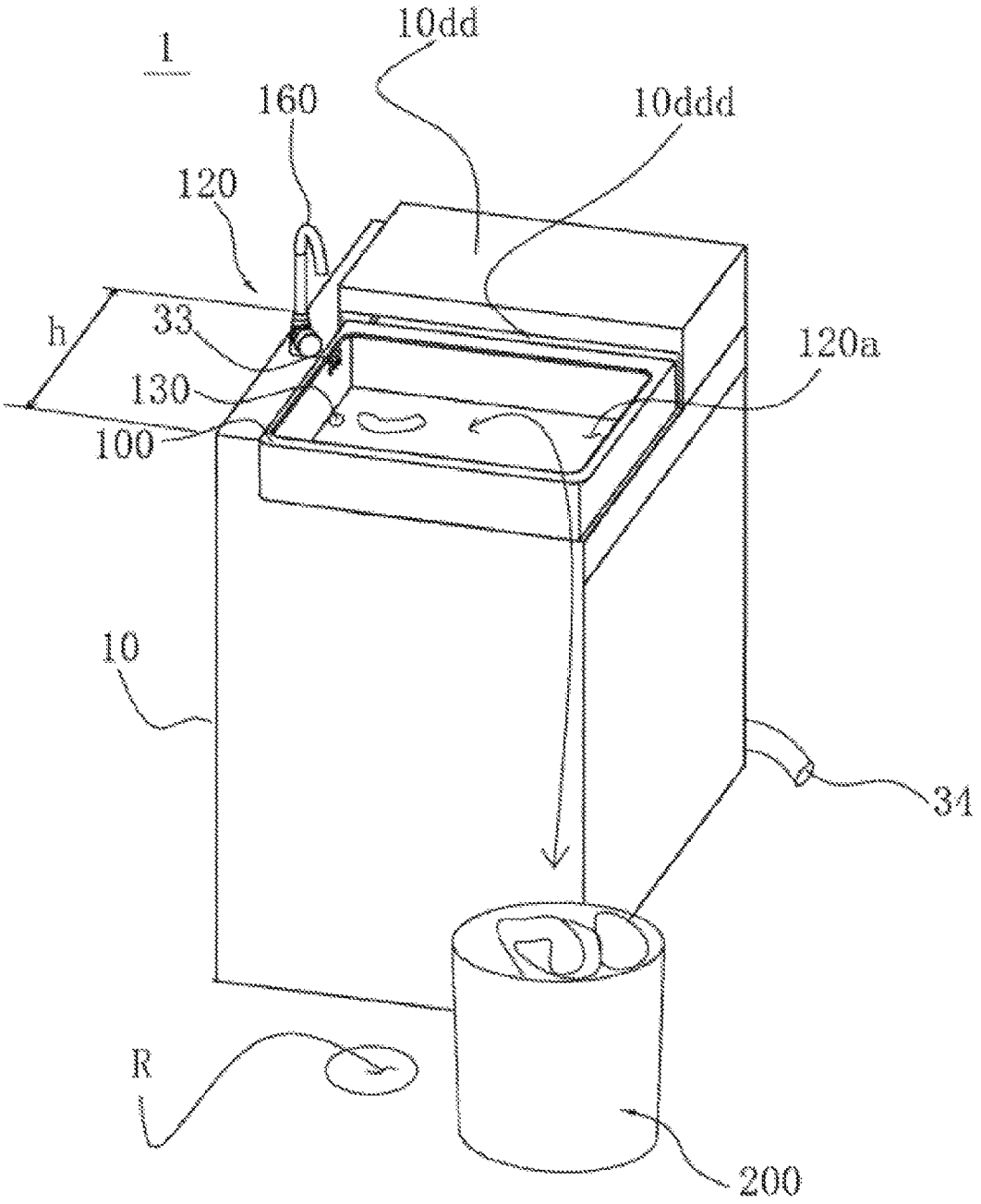

FIGS. 12 and 13 are perspective views of the washing machine with a sheltering device 10*dd* according to the seventh preferred embodiment of the present invention, illustrating the auxiliary washing unit in different states.

The main washing machine body 10 further comprises a sheltering device 10*dd*. The sheltering device 10*dd* has an inner cavity 10*ddd* larger than the doorsets assembly 100.

When the doorsets assembly 100 is moved in the Y2 direction, the doorsets assembly 100 is received inside the inner cavity 10*ddd* of the sheltering device 10*dd* to be hidden.

Preferably, articles, such as detergents, can be placed on top of the sheltering device 10*dd*.

Preferably, the switch control device 90 of the washing machine is arranged on the sheltering device 10*dd* (as shown in FIG. 18).

Figure 21:
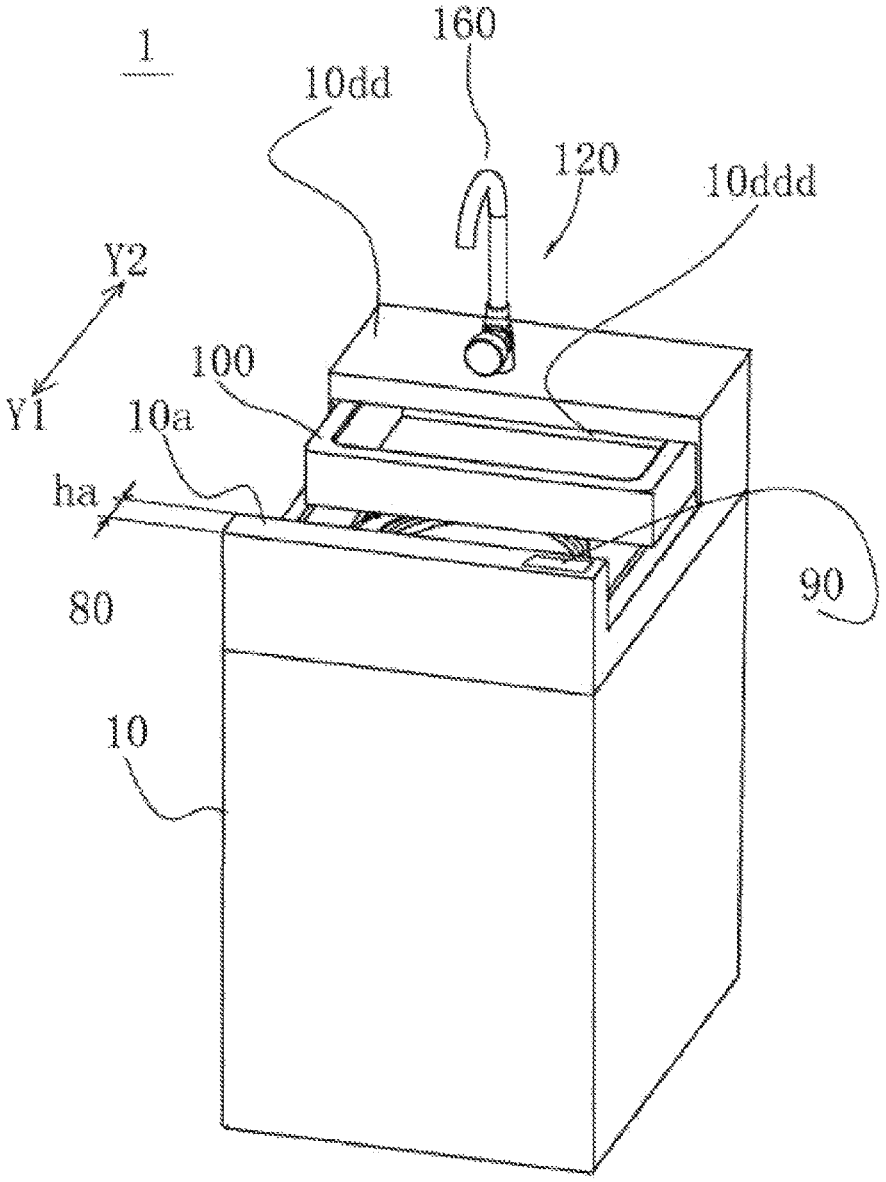

Preferably, the water supply device 160 is mounted on the sheltering device 10*dd* (as shown in FIG. 21).

Figure 20:
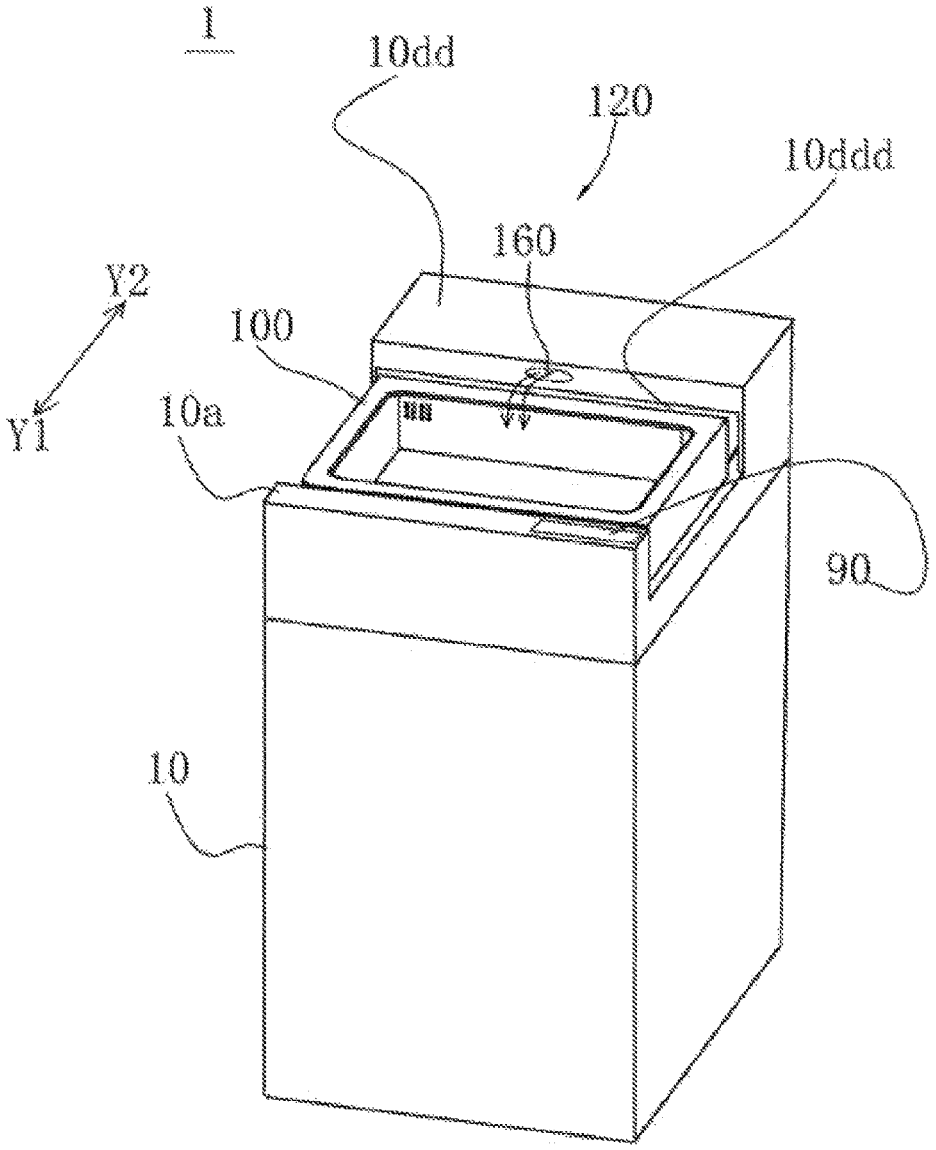

Preferably, the water supply device 160 is hidden inside the sheltering device 10*dd* (as shown in FIG. 20).

Hereinafter, a washing machine according to an eighth embodiment of the present invention is illustrated, wherein those components and configurations having same structure as the above first, second, third, fourth, fifth, sixth and seventh preferred embodiment are not repeatedly described in the following.

Figure 14:
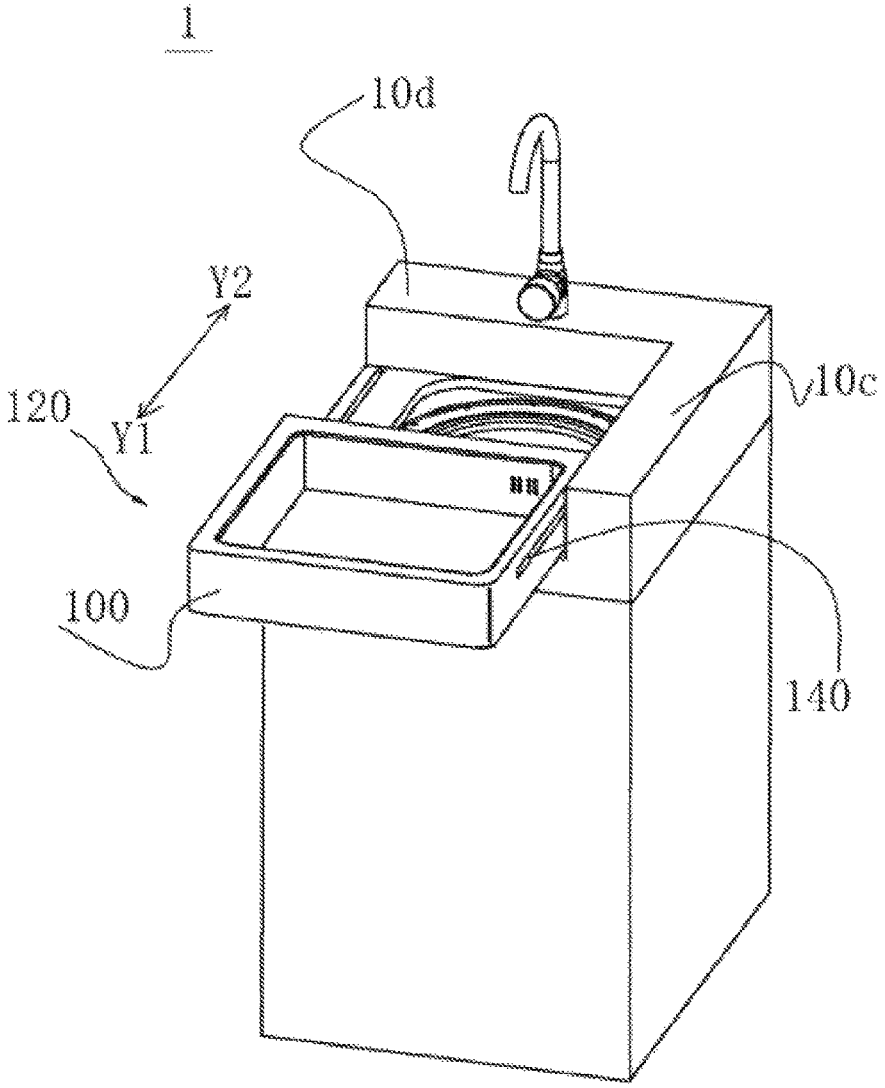
FIG. 14 is a perspective view of the washing machine according to an eighth preferred embodiment of the present invention, illustrating the auxiliary washing unit in different alternative mode.

FIG. 14 is a perspective view of the washing machine according to an eighth preferred embodiment of the present invention, illustrating the auxiliary washing unit in different structure.

According to the embodiment, the washing machine further comprises a right wing 10*c*, wherein the slide unit 140 is mounted on the right wing 10*c* for connecting to the doorsets assembly 100. That is, the doorsets assembly 100 is connected to the right wing 10*c* by the slide unit 140, so that one side of the doorsets assembly 100 is movable along the right wing 10*c*.

Preferably, the doorsets assembly 100 is surrounding by the rear wing 10*d*.

Preferably, the height of the rear wing 10*d* or/and the right wing 10*c* can be predetermined as required.

Hereinafter, a washing machine according to an ninth embodiment of the present invention is illustrated, wherein those components and configurations having same structure as the above first, second, third, fourth, fifth, sixth, seventh and eighth preferred embodiment are not repeatedly described in the following.

Figure 15:
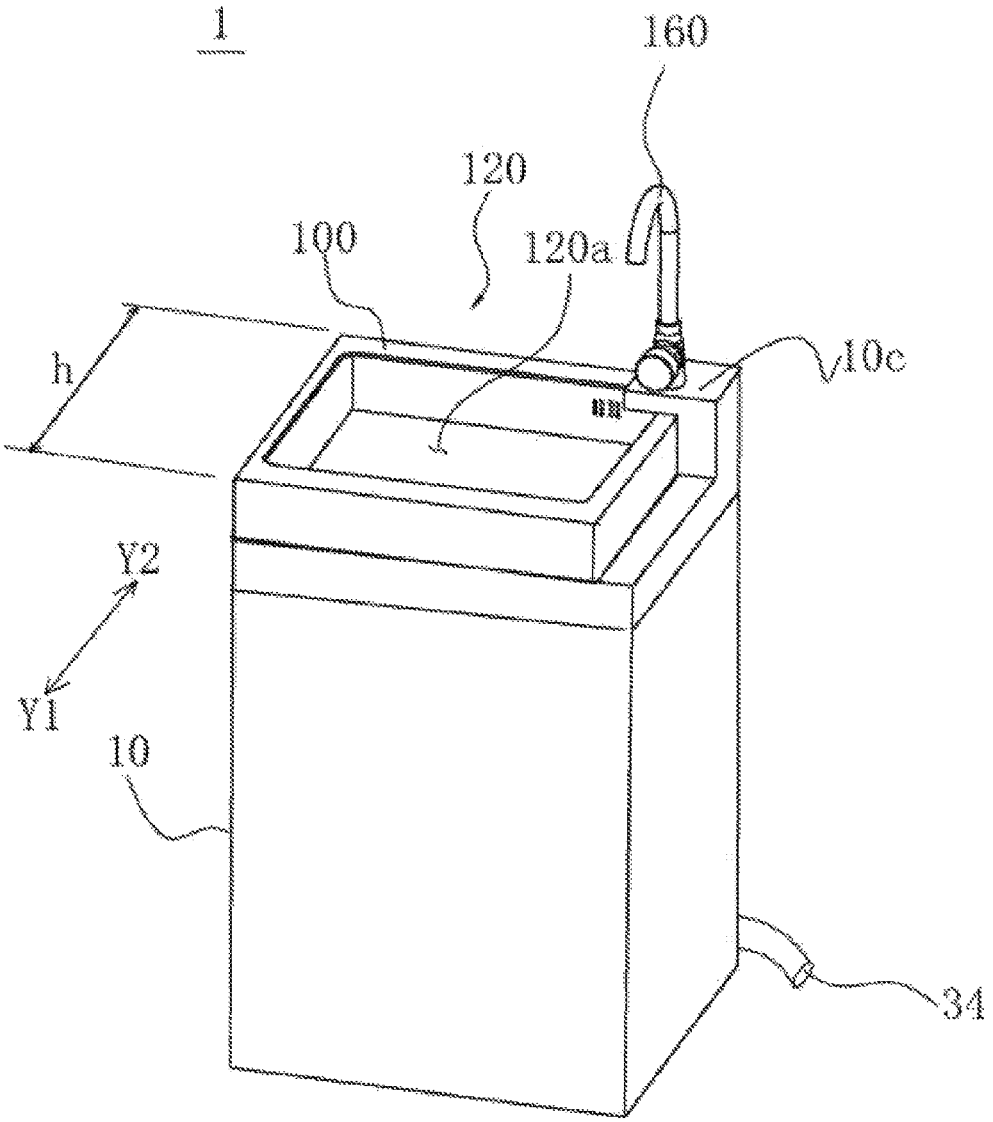
FIGS. 15, 16 and 17 are perspective views of the washing machine according to a ninth preferred embodiment of the present invention, illustrating the auxiliary washing unit in different alternative modes.
Figure 16:
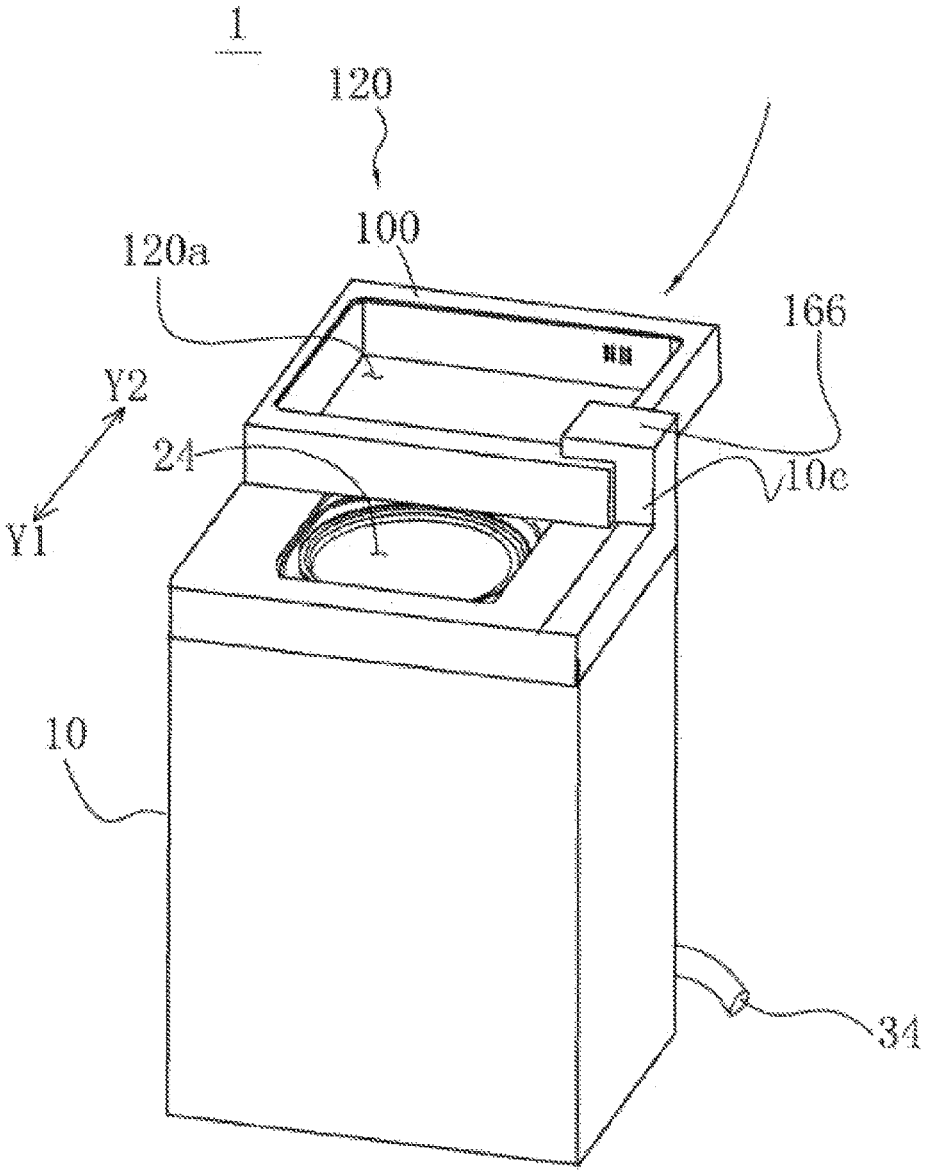
Figure 17:
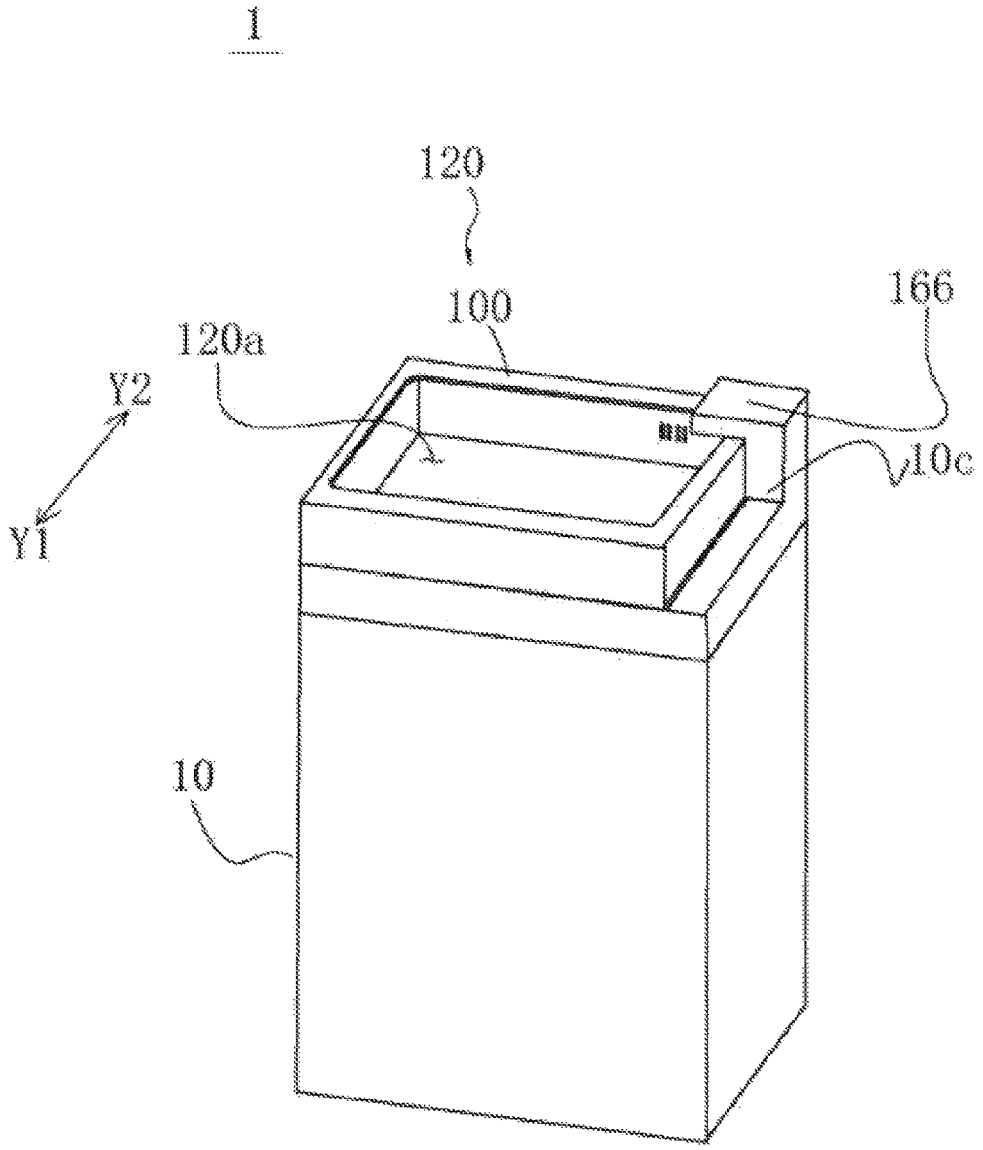

FIGS. 15, 16 and 17 are perspective views of the washing machine according to a ninth preferred embodiment of the present invention, illustrating the auxiliary washing unit in different states.

Optionally, the doorsets assembly 100 is surrounded by the right wing 10*c* shaped as a small block.

The auxiliary water supply pipe 166 for the washing space 120*a* can be preferably concealedly mounted inside the right wing 10*c*, as shown in FIG. 16. Or the auxiliary water supply pipe 166 for the washing space 120*a* can be preferably mounted to extend from the right wing 10*c*, as shown in FIG. 17.

Hereinafter, a washing machine according to an tenth embodiment of the present invention is illustrated, wherein those components and configurations having same structure as the above first, second, third, fourth, fifth, sixth, seventh, eighth and ninth preferred embodiment are not repeatedly described in the following.

FIGS. 18, 19, 20, 21 and 22 are perspective views of the washing machine according to a tenth preferred embodiment of the present invention, illustrating the auxiliary washing unit in different states.

Optionally, the width m of the doorsets assembly 100 is set larger comparing with above embodiments, and the sheltering device 10*dd* has a large inner cavity 10*ddd* that can receive the doorsets assembly 100 inside.

The doorsets assembly 100 of the washing machine is movable along the Y1 direction or along the Y2 direction. And the inner cavity 10*ddd* is used to receive part of or all of the doorsets assembly 100 therein when moving the doorsets assembly 100 in the Y2 direction, so that part of or all of the doorsets assembly 100 can be hidden under the sheltering device 10*dd*. When the doorsets assembly 100 is moved along the Y2 direction, the opening 24 is opened, and the laundry to be washed can be put into the rotary tub 12 through the opening 24. When the doorsets assembly 100 is moved along the direction of Y1, the doorsets assembly 100 is pulled out of the sheltering device 10*dd* and the opening 24 is closed. It is appreciated that putting laundries into or taking laundries out of the opening 24 into the rotary tub 12 will not interrupt and affect interrupting the softening or soaking work inside the upper hand washing container nor wasting washing water.

The positions illustrated as R in drawings are the position where the user stands. When the auxiliary washing space 120*a* is moved closer to the position R where the user stands, it is beneficial for the user to operate in the auxiliary washing space of the auxiliary washing unit to soften or soak laundries, wash laundries or wash faces.

Figure 19:
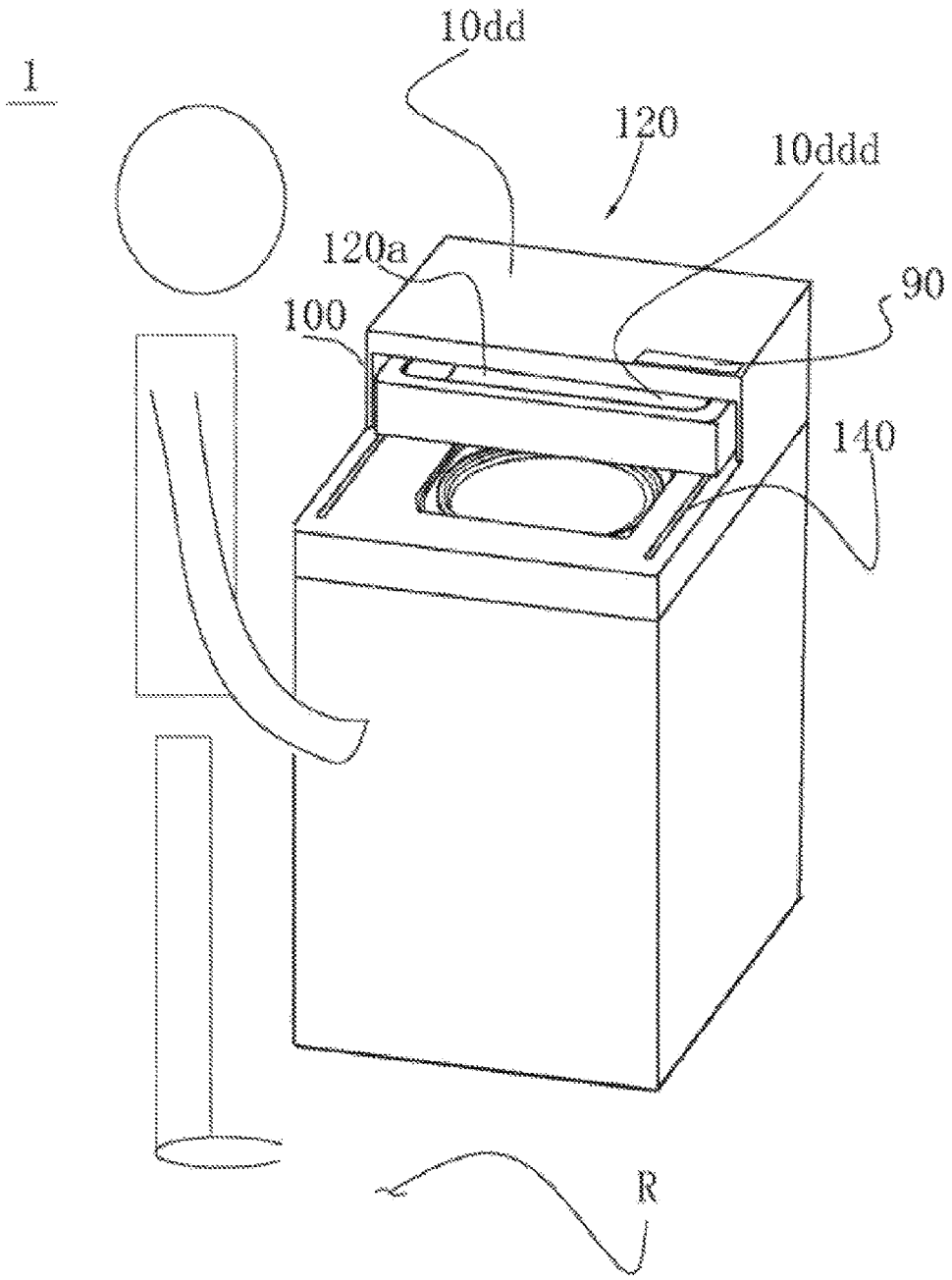

As shown in FIGS. 18 and 19, the switch control unit 90 of the washing machine is arranged on the sheltering device 10*dd*. Optionally, as shown in FIGS. 20 and 21, the switch control unit 90 is arranged on the front wing 10*a*.

Optionally, the height of the front wing 10*a* is predetermined as required.

As shown in FIG. 20, in the embodiment, the water supply device 160 is preferably provided inside the sheltering device 10*dd*.

Figure 22:
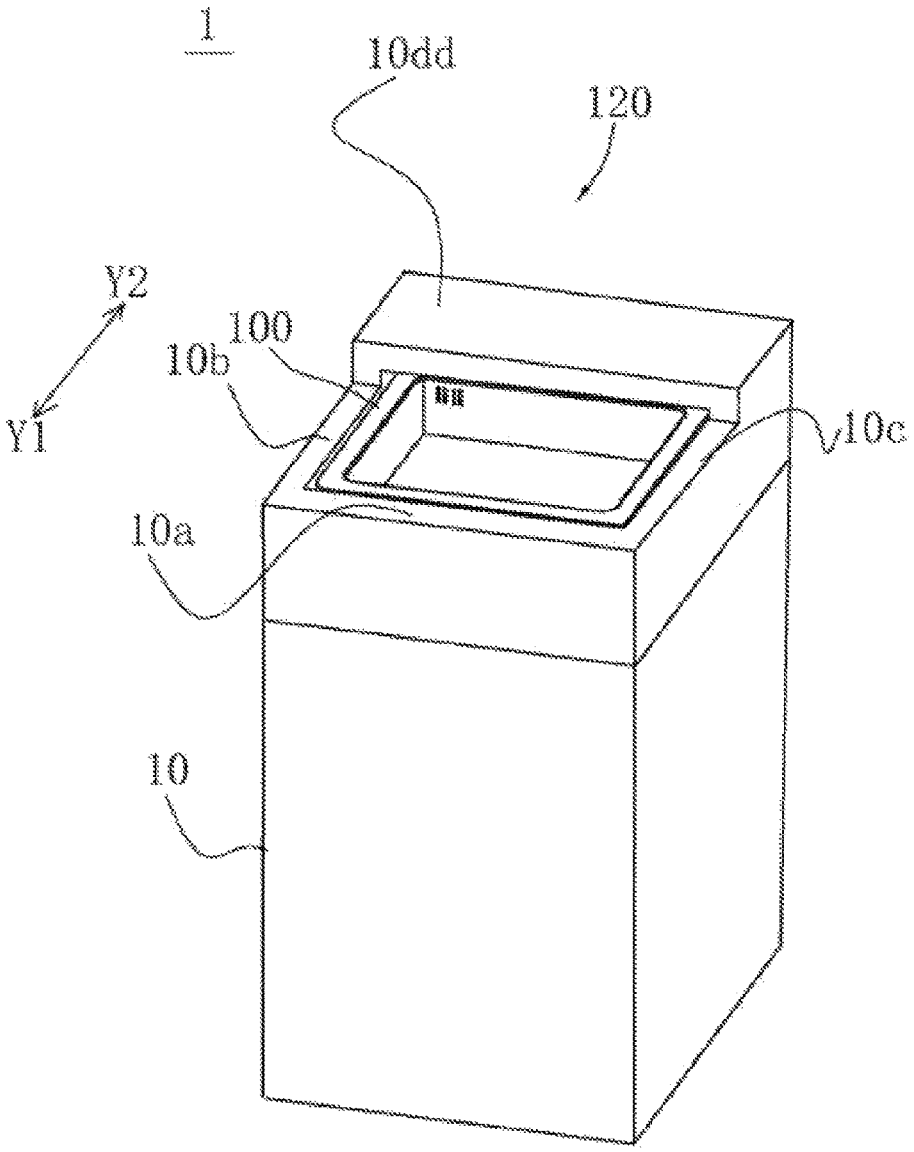

As shown in FIG. 22, the main washing machine body 10 according to the present invention further comprises a front wing 10*a*, a left wing 10*b*, and a right wing 10*c*.

Optionally, the main washing machine body 1 and the auxiliary washing unit 120 are coupled through the locking member 150, so the user can conveniently open and close the doorsets assembly 100. Since the first main washing space 11*a* is required to be used, the auxiliary washing unit 120 is pulled out and locked to the main washing machine body through the locking member 150.

When it is not necessary to use the auxiliary washing unit or it is necessary to put laundries into or take laundries out of the first main washing space 11*a*, the lock member 150 is unlocked so as to push the auxiliary washing unit 120 back. The user can lock or unlock the lock member 150 as needed.

Optionally, the locking member 150 can be arranged between the doorsets assembly 100 and the front wing 10*a*, or between the doorsets assembly 100 and the left wing 10*b*, or between the doorsets assembly 100 and the right wing 10*c*.

Optionally, the height of the front wing 10*a* or/and the left wing 10*b* or/and the rear wing 10*d* or/and the right wing 10*c* is predetermined as required.

The washing machine further comprises the automatic auxiliary device (not shown), in which the mechanical movement of the doorsets assembly 100 of opening or closing can automatically controlled by a switch control unit 90.

Hereinafter, a washing machine according to an eleventh embodiment of the present invention is illustrated.

Figure 23:
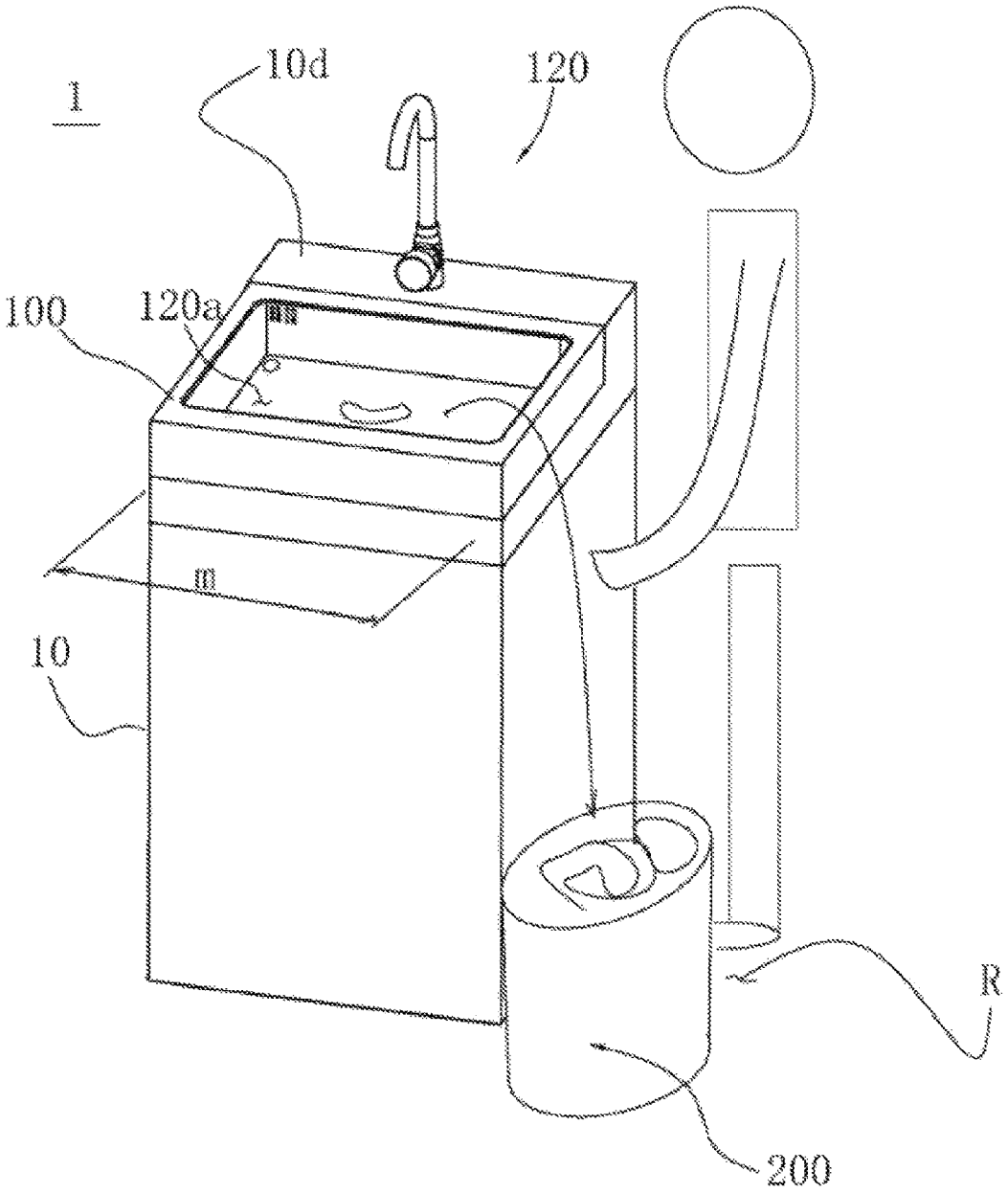
FIGS. 23 and 24 are perspective views of the washing machine according to an eleventh preferred embodiment of the present invention, illustrating the auxiliary washing unit in different alternative modes.
Figure 24:
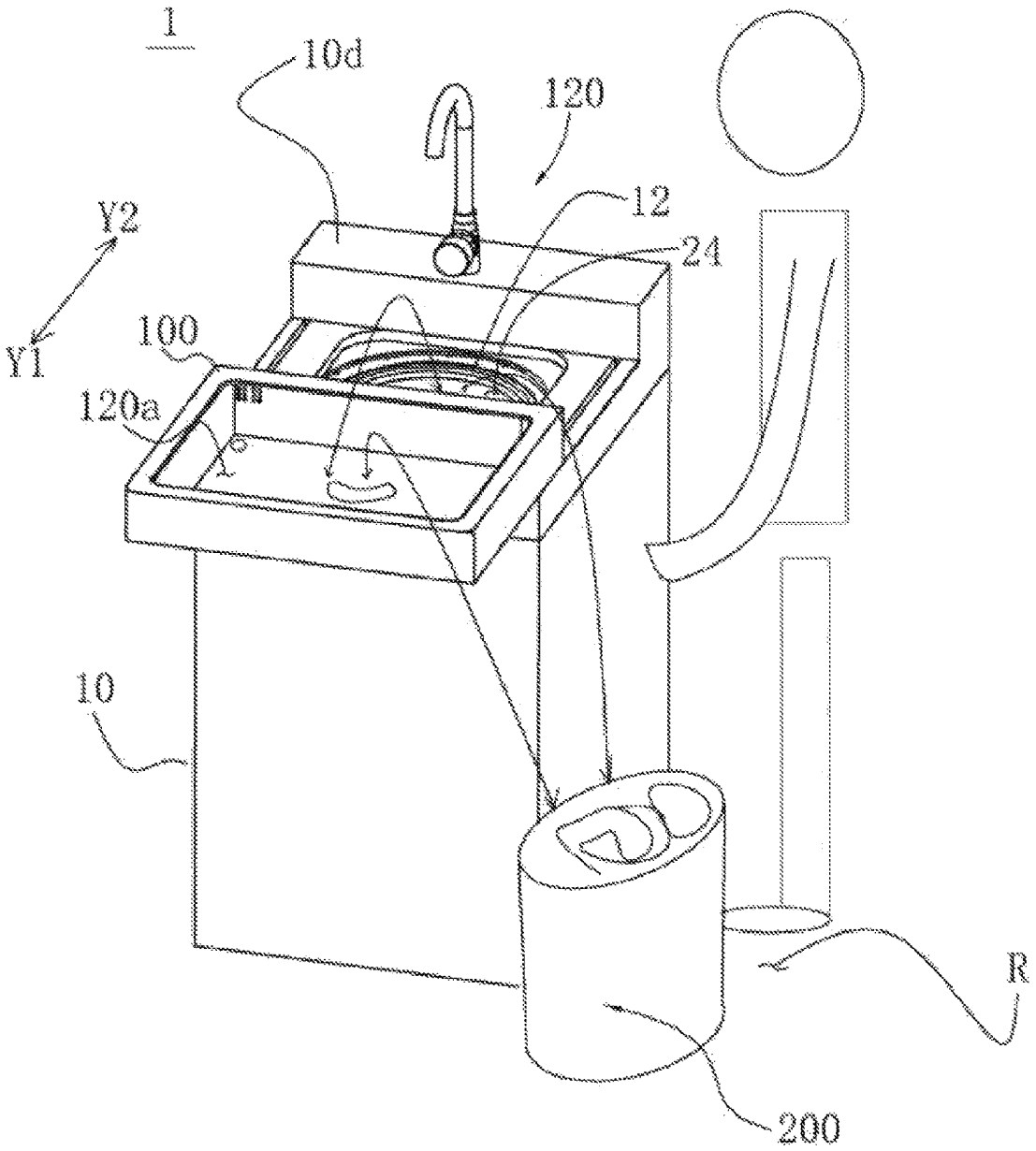

FIGS. 23 and 24 are perspective views of the washing machine according to an eleventh preferred embodiment of the present invention, illustrating the auxiliary washing unit in different states. The positions illustrated as R in drawings are the position where the user stands.

Optionally, the doorsets assembly 100 is connected to the rear wing 10*d*. The doorsets assembly 100 has a width of m, and the doorsets assembly 100 has an hand washing container of a width of m formed therein. The slide unit 140 may also be preferably disposed between the bottom surface of the doorsets assembly 100 and the main washing machine body 10. The doorsets assembly 100 of the washing machine is movable along the Y1 direction or along the Y2 direction. When the doorsets assembly 100 is moved along the Y1 direction, the opening 24 is opened and the laundry can be put into the rotary tub 12 through the opening 24.

Hereinafter, a washing machine according to a twelfth embodiment of the present invention is illustrated.

Figure 25:
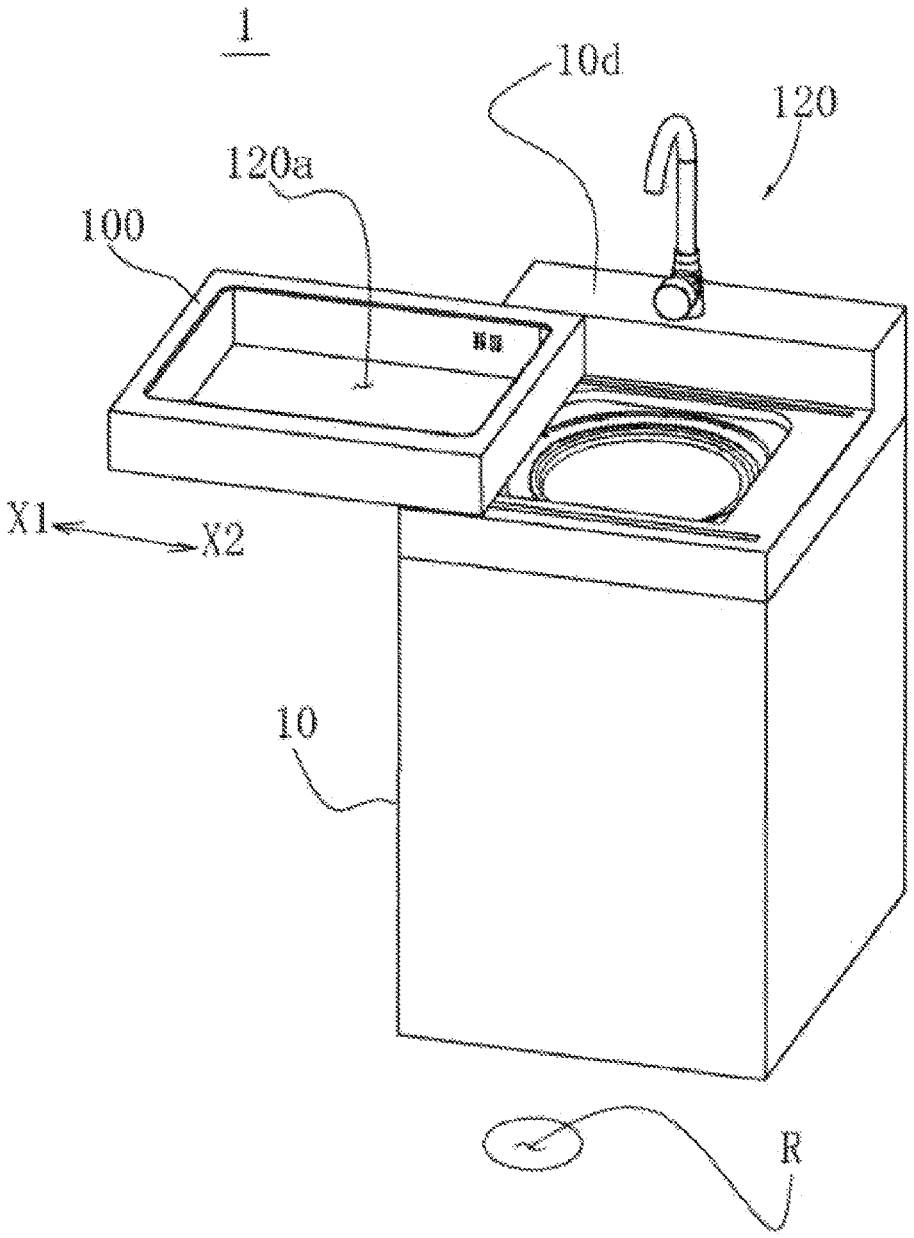
FIG. 25 is a perspective view of the washing machine according to a twelfth preferred embodiment of the present invention, illustrating the auxiliary washing unit in different alternative mode.

FIG. 25 is a perspective view of the washing machine according to a twelfth preferred embodiment of the present invention, illustrating the auxiliary washing unit in different structure.

Compared with FIG. 24, the difference is that the doorsets assembly 100 of the washing machine is arranged to be movable along the X1 direction or the X2 direction. When the doorsets assembly 100 is moved along the X1 direction, the opening 24 is opened and the laundry can be put into the rotary tub 12 through the opening 24.

Hereinafter, a washing machine according to a thirteenth embodiment of the present invention is illustrated.

FIGS. 26, 27, 28 and 29 are perspective views of the washing machine according to a thirteenth preferred embodiment of the present invention, illustrating the auxiliary washing unit in different states.

According to FIG. 26, FIG. 27, FIG. 28, and FIG. 29, the washing machine 1 comprises the main washing machine body 10 having an opening 24 on the upper side and comprising the first main washing space 11*a* communicated with the opening 24, and the auxiliary washing unit 120 comprising the doorsets assembly 100 configured above the opening 24 to be pivoted relative to the main washing machine body in a horizontal direction to open or close the opening 24, wherein the doorsets assembly 100 has an recess to form the auxiliary washing space 120*a*. The doorsets assembly 100 is rotated horizontally around an axis 500 to open or close the opening 24.

Figure 26:
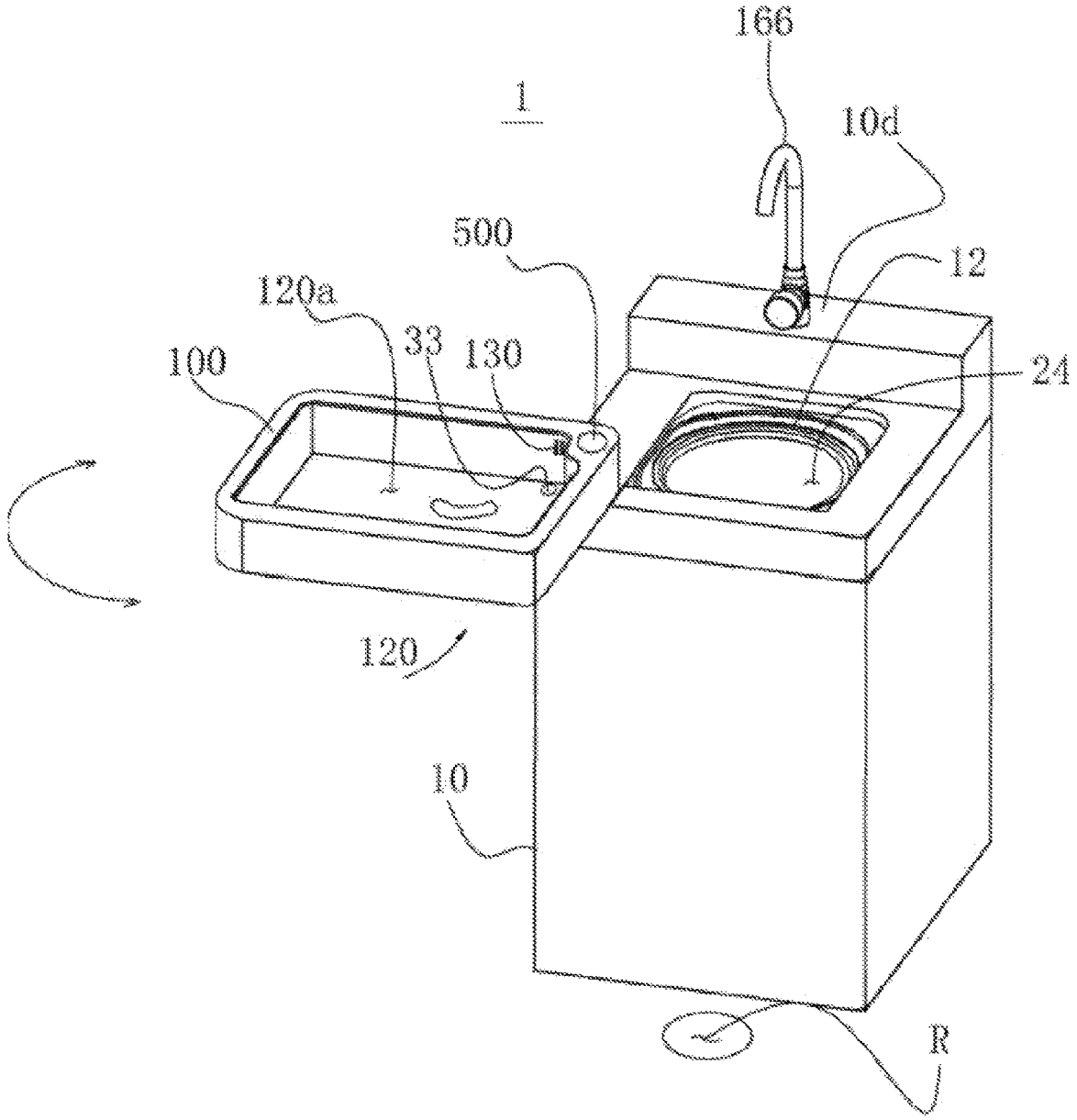
FIGS. 26, 27, 28 and 29 are perspective views of the washing machine according to a thirteenth preferred embodiment of the present invention, illustrating the auxiliary washing unit in different alternative modes.
Figure 27:
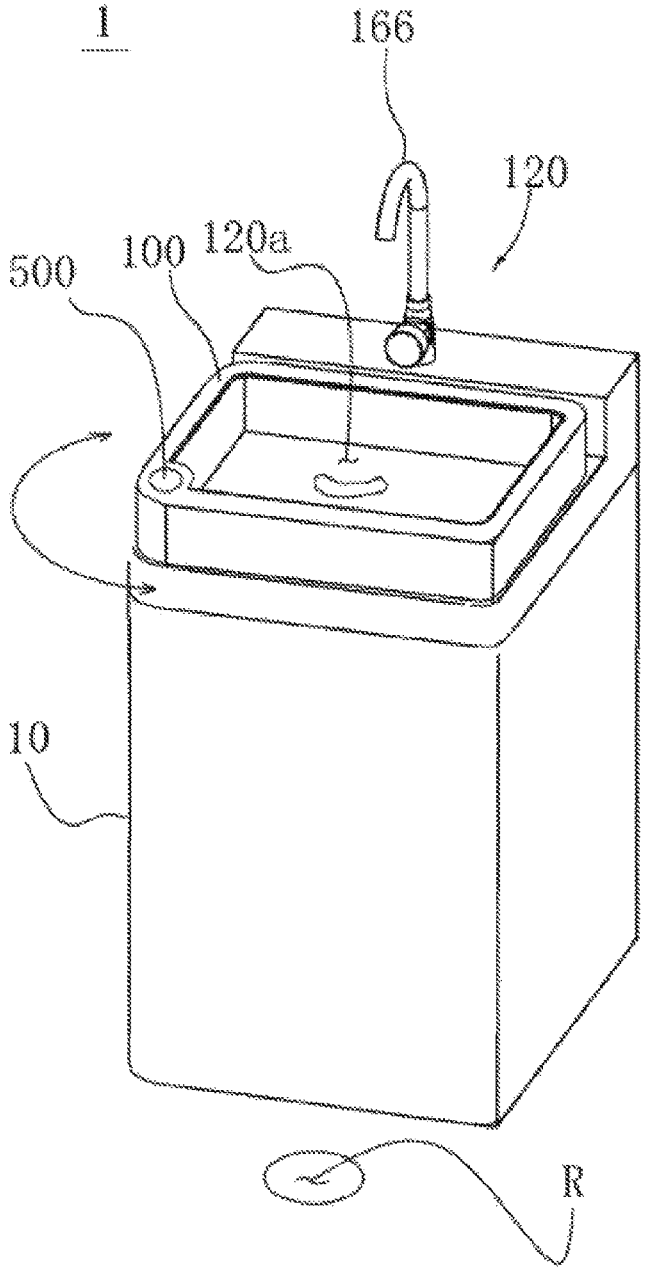

Optionally, FIGS. 26 and 27 show that the axis 500 is in a front left direction of the main washing machine body of the washing machine 1.

The positions illustrated as R are the position where the user stands. When the doorsets assembly 100 of the washing machine is rotated horizontally to open the opening 24, the laundry to be washed can be put into the rotary tub 12 through the opening 24. When the doorsets assembly 100 opens the opening 24, the process of taking laundries from the opening 24 into the rotary tub 12 will not interrupt and affect the work of softening or soaking work inside the upper hand washing container without wasting washing water.

When the hand washing container is moved closer to the position R where the user stands, it is beneficial for the user to soften, soak or wash laundries or wash faces in the hand washing container.

Figure 28:
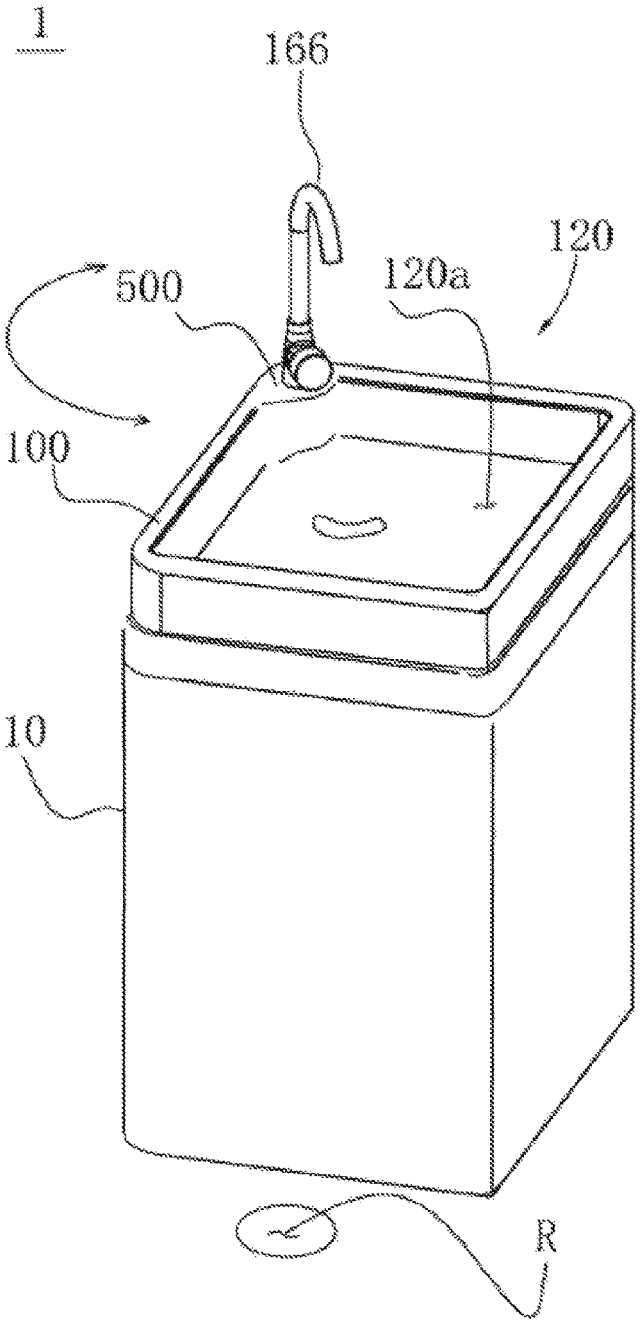
Figure 29:
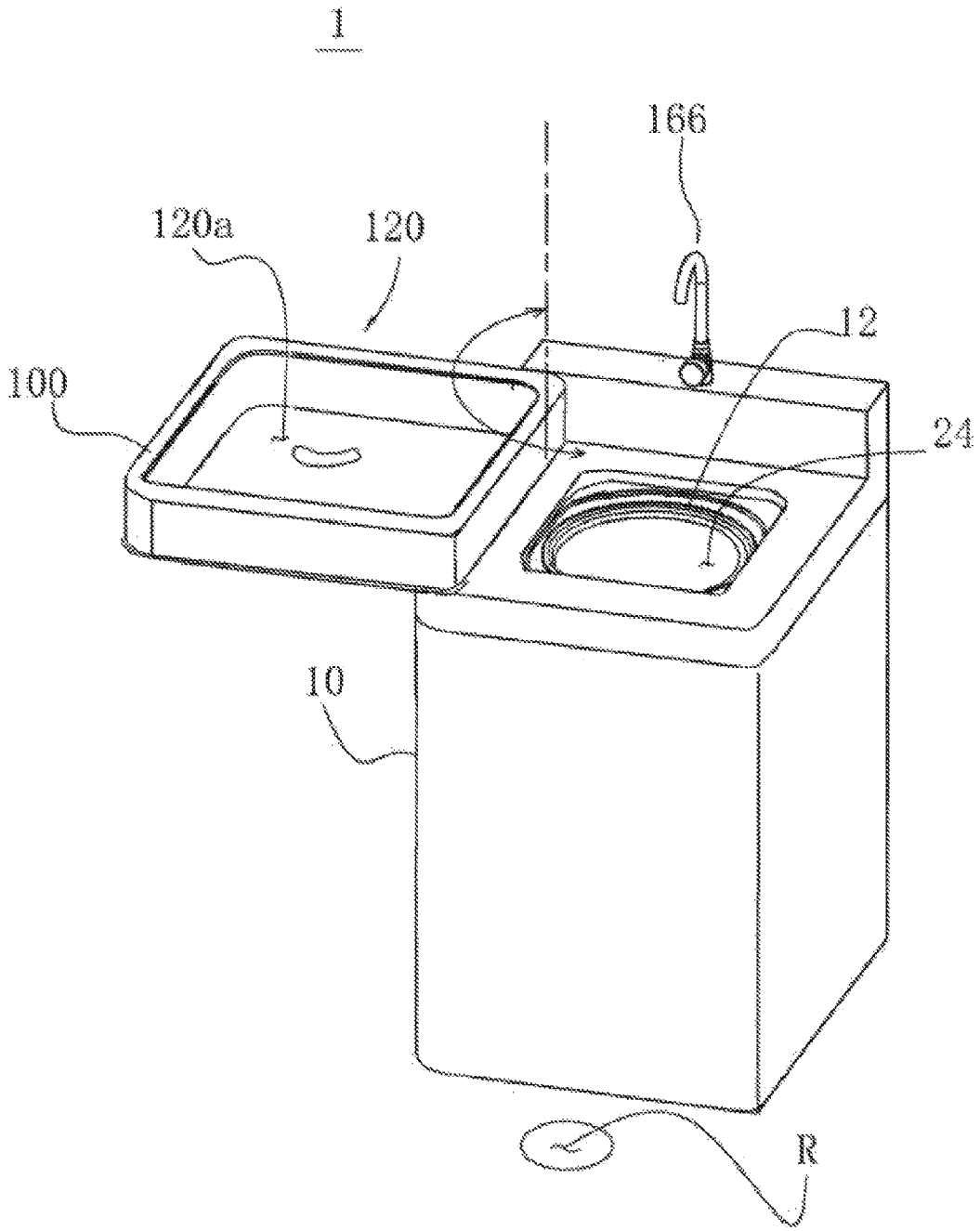

Optionally, FIGS. 28 and 29 show that the axis 500 is at the rear left direction of the main washing machine body of the washing machine 1.

Optionally, the orientation of the axis 500 in the washing machine 1 is not limited as the above. According to requirements, it can be arranged in any orientation desired, such as the front, rear, left, right direction of the main washing machine body of the washing machine 1.

Optionally, the main washing machine body 1 and the auxiliary washing unit 120 are coupled through the locking member 150, and a user can conveniently open or close the doorsets assembly 100. When the first main washing space 11*a* is to be used for washing, the auxiliary washing unit 120 is horizontally rotated to move to close the opening, and the locking member 150 is locked.

When auxiliary washing is not needed or laundries are needed to be put into or taken out of the first main washing space 11*a*, the locking member 150 is unlocked for moving the auxiliary washing unit 120 in horizontal rotation to open the opening. The user can lock or unlock the lock member 150 as needed to secure the position between the auxiliary washing unit and the main washing machine body.

Hereinafter, a washing machine according to a fourteenth embodiment of the present invention is illustrated, wherein those components and configurations having same structure as the above first, second, third, fourth, fifth, sixth, seventh, eighth, ninth, tenth, eleventh, and twelfth preferred embodiment are not repeatedly described in the following.

Figure 30:
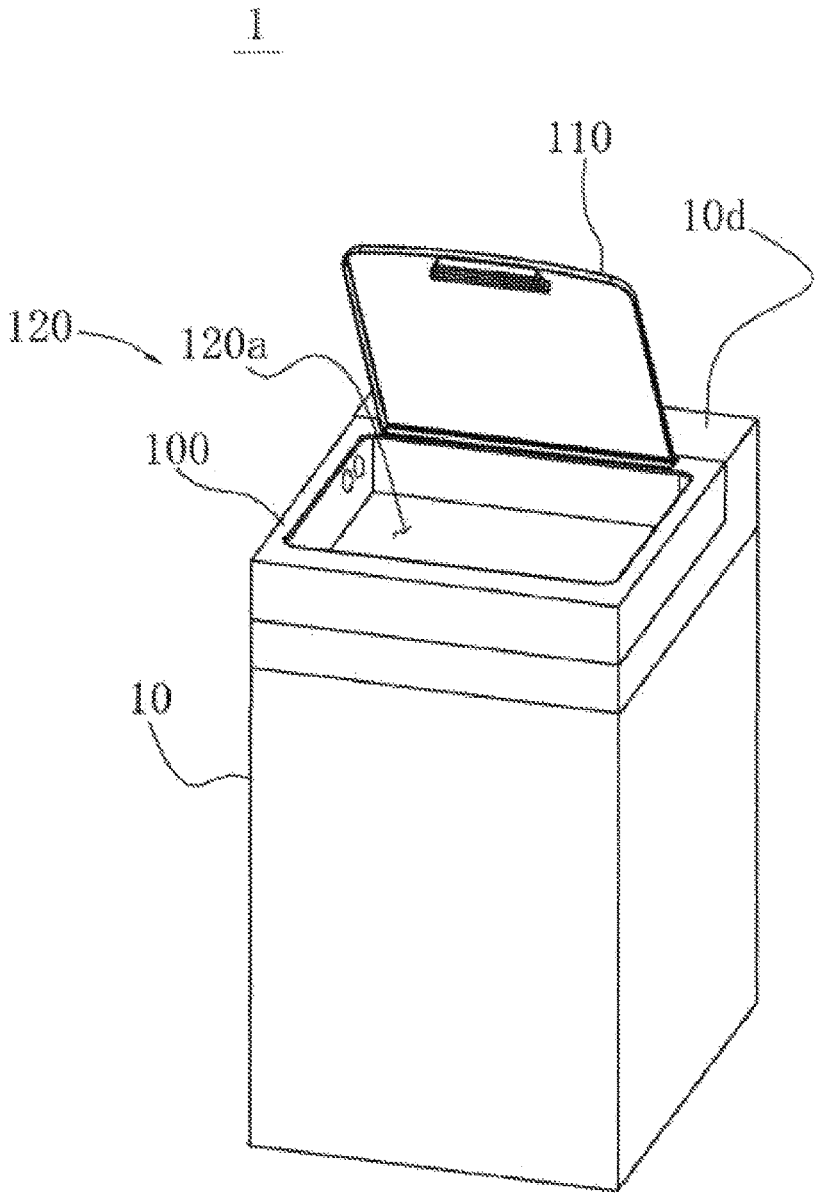
FIGS. 30 and 31 are perspective views of the washing machine according to a fourteenth preferred embodiment of the present invention, illustrating the auxiliary washing unit with covering structure.
Figure 31:
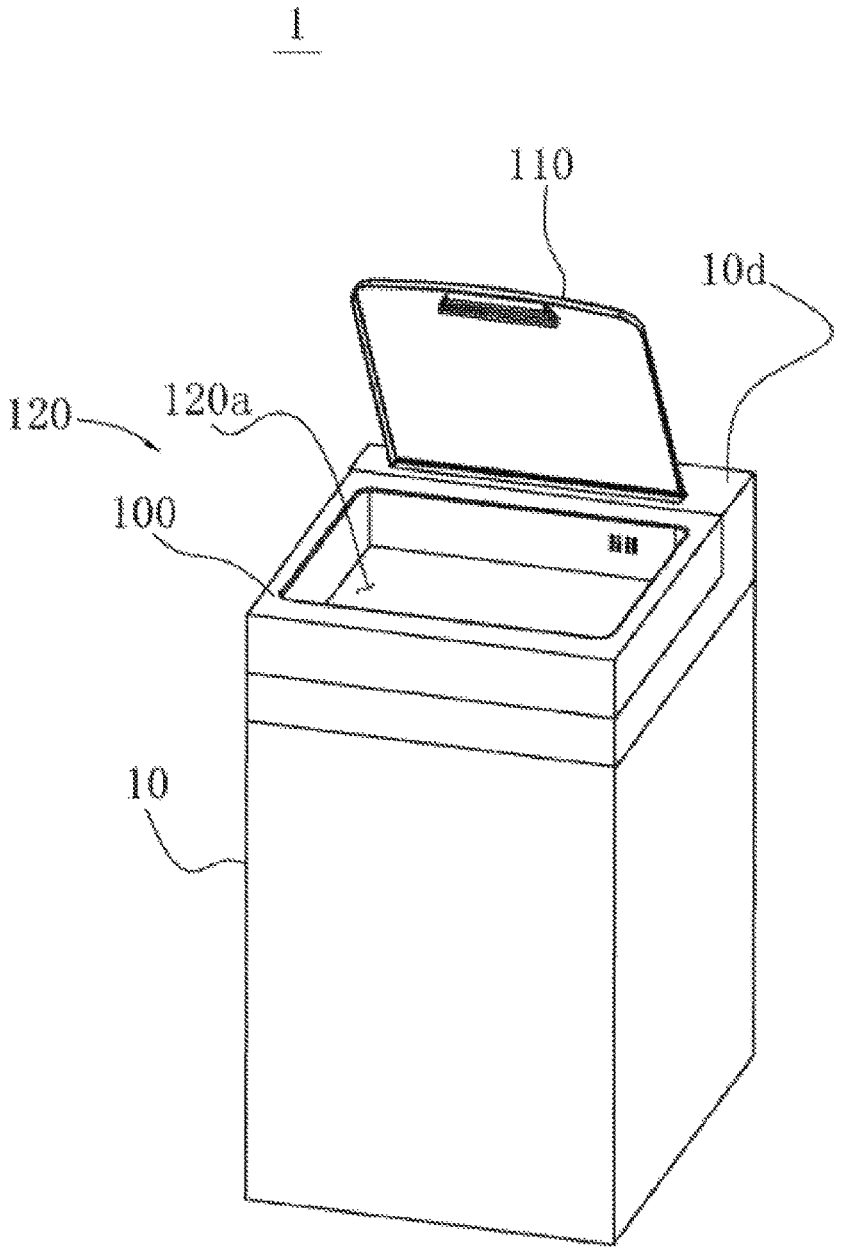

FIGS. 30 and 31 are perspective views of the washing machine according to a fourteenth preferred embodiment of the present invention, illustrating the auxiliary washing unit with covering structure.

As shown in FIG. 30, the auxiliary washing unit 120 further comprises a pivotable cover 110 mounted on the doorsets assembly 100. Preferably, the pivotable cover 110 is mounted on the rear wing 10*d*, as shown in FIG. 31.

The cover 110 is pivoted upward to open the auxiliary washing space 120*a*, and the cover 110 is pivoted downward to close the auxiliary washing space 120*a*.

Hereinafter, a washing machine according to a fifteenth embodiment of the present invention is illustrated.

Figure 32:
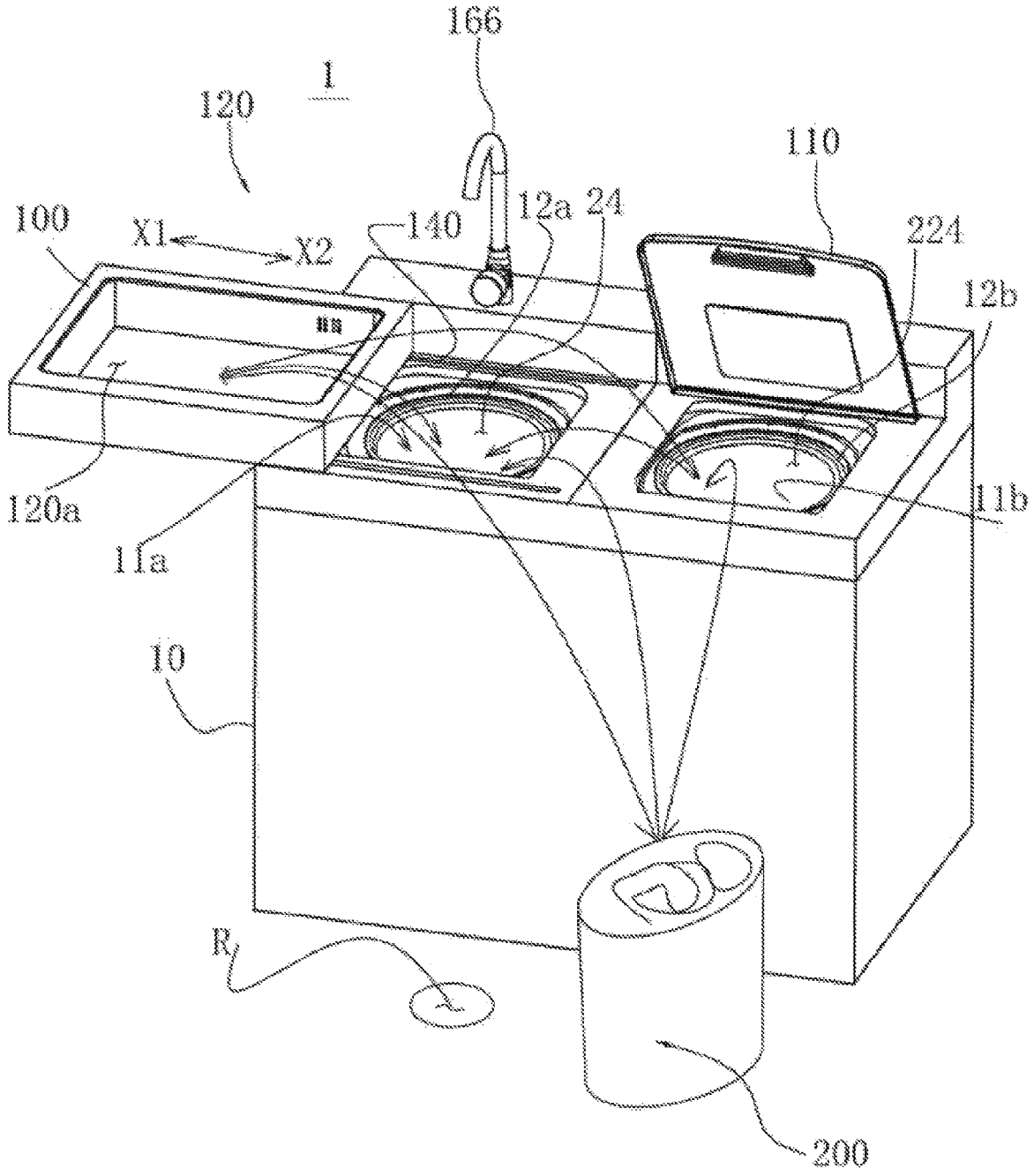
FIGS. 32, 33 and 34 are perspective views different alternative modes of the washing machine with several tubs according to a fifteenth preferred embodiment of the present invention, illustrating the auxiliary washing unit.
Figure 33:
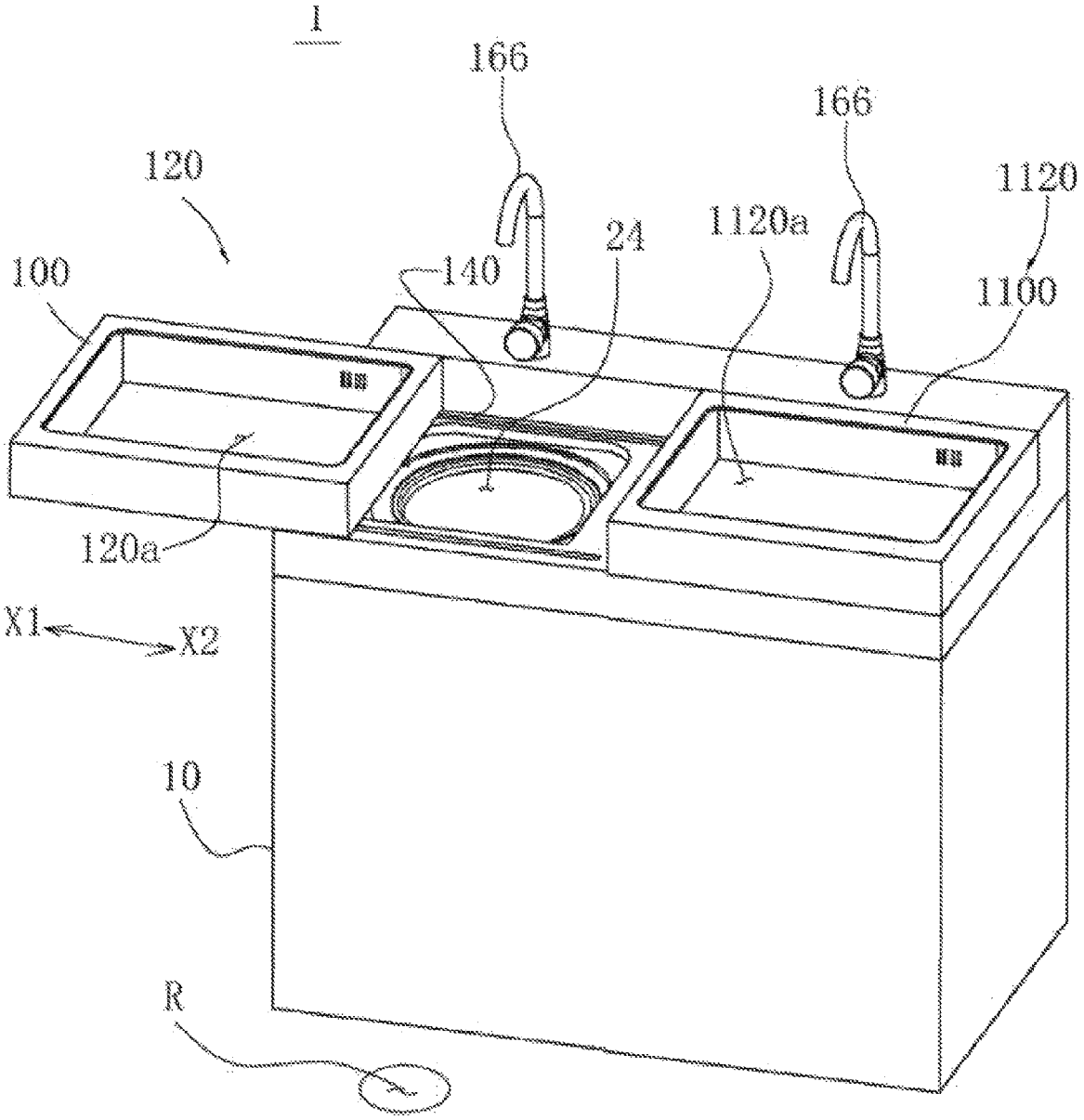
Figure 34:
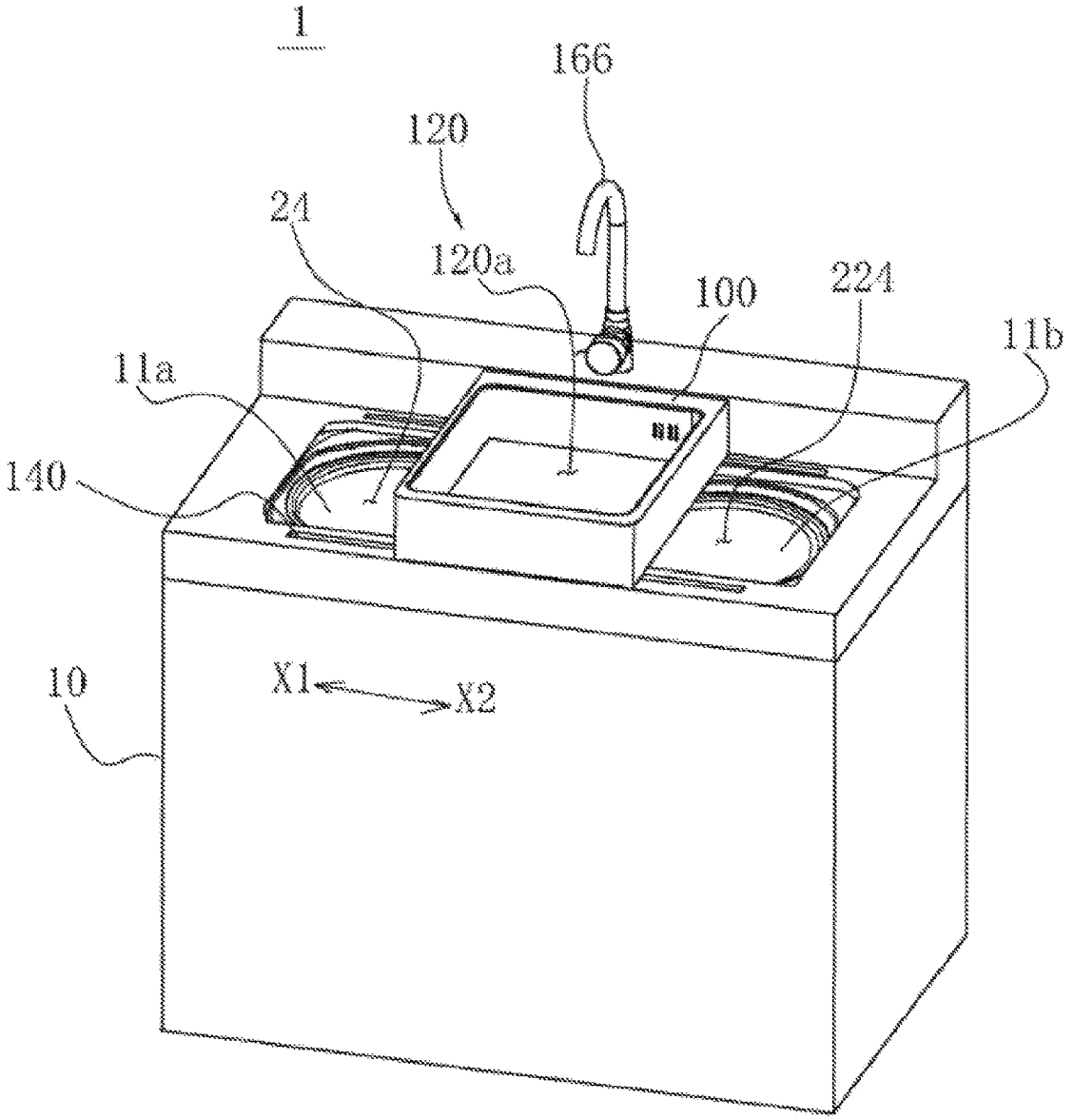

FIGS. 32, 33 and 34 are perspective views of the washing machine with several tubs according to a fifteenth preferred embodiment of the present invention, illustrating the auxiliary washing unit.

The washing machine 1, as shown in FIG. 32, comprises: a main washing machine body 10 having a first main washing space 11*a* communicated with the first opening 24 on the top thereof, a first rotary tub 12*a*, a second main washing space 11*b* communicated with an upper second opening 224, a second rotary tub 12*b* and the auxiliary washing unit 120 comprising the doorsets assembly 100 configured above the opening 24 to be pulled to move relative to the main washing machine body in a horizontal direction to open or close the opening 24. The auxiliary washing unit 120 further comprises a pivotable cover 110 mounted above second main washing space 11*b*.

The positions illustrated as R are the position where the user stands. When the doorsets assembly 100 of the washing machine is moved horizontally to open the opening 24, the laundry to be washed can be put into the rotary tub 12 through the opening 24. When the doorsets assembly 100 opens the opening 24, the process of taking laundries from the opening 24 into the rotary tub 12 will not interrupt and affect the work of softening or soaking work inside the upper hand washing container without wasting washing water.

When the hand washing container is moved closer to the position R where the user stands, it is beneficial for the user to soften, soak or wash laundries or wash faces in the hand washing container.

It is appreciated that the washing machine 1 according to the present invention can achieve synergies of user's space requirements for laundries inside the laundry basket 200, in the first rotary tub 12*a*, in the hand washing container, in the second rotary tub 12*b* and in auxiliary washing space 120*a*.

As shown in FIG. 33, the difference is that the washing machine further comprises a second auxiliary washing unit 1120 above the second main washing space 11*b*. The second auxiliary washing unit 1120 comprises a second doorsets assembly 1100, and the second doorsets assembly 1100 comprises a second auxiliary washing space 1120*a*, that is, the second doorsets assembly also has a recessed portion to form a second auxiliary washing space 1120*a*. When the second doorsets assembly 1100 closes the second opening 224, the operation of putting laundries into or taking laundries out of the second opening 224 into the second rotary tub 12*b* will not interrupt and affect the laundries in the hand washing container to soften or soaking, and will not waste washing water. Compared with the washing machine shown in FIG. 32, the washing machine shown in FIG. 33 has more coordination functions for users to choose, and may achieve better efficient washing, save time, and reduce operation intensity.

The sliding arrangement of the doorsets assembly 100 of the auxiliary washing unit 120 and the doorsets assembly 1100 of the second auxiliary washing unit 1120 can be designed similar as the structure of other illustrated embodiments.

Optionally, as shown in FIG. 34, the doorsets assembly 100 is provided to slide above the first main washing space 11*a* and the second main washing space 11*b*.

The doorsets assembly 100 does not slide out of the peripheral of the washing machine 1, and does not increase the floor space of the washing machine 1 so as not to occupy much of the user's living room space with allowing the operation of putting laundries into or taking laundries out of the main washing space without interrupting the softening or soaking work inside the upper hand washing container.

Optionally, the washing machine with multiple tubs according to this embodiment can be embodied in structure of a two-tub, three-tub, four-tub, or five-tub configuration.

Optionally, the washing machine with multiple tubs as shown in this fourth preferred embodiment is not limited to the structure comprising the rotary tub 12*a* (or the second rotary tub 12*b*), the stationary tub 11*a* (or the second stationary tub 11*b*) and the pulsator 50. In other words, the first main washing space 11*a* and the second washing space 11*b* may be embodied with a single dehydration, spin-drying, or dryer function of drying laundries without washing function.

Hereinafter, a washing machine according to a sixteenth embodiment of the present invention is illustrated, wherein those components and configurations having same structure as the above first, second, third, fourth, fifth, sixth, seventh, eighth, ninth, tenth, eleventh, twelfth, thirteenth, and fourteenth preferred embodiment are not repeatedly described in the following.

Figure 35:
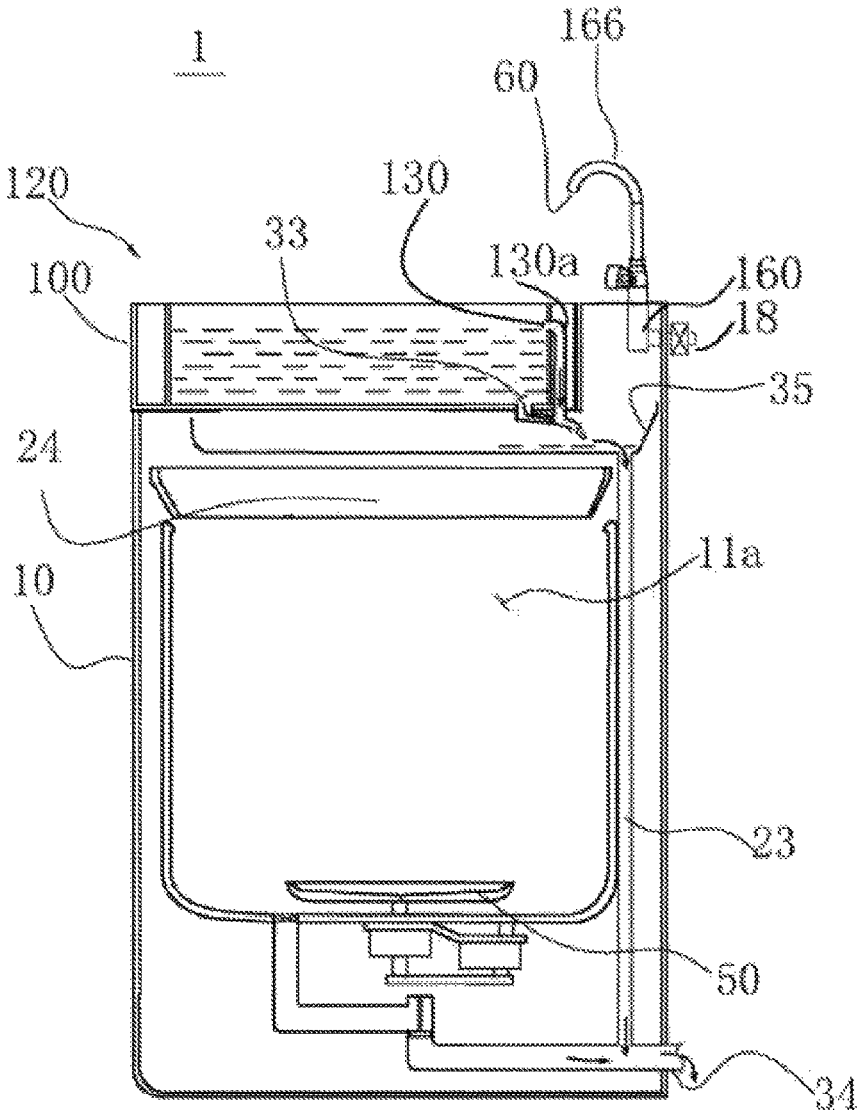
FIG. 35 is a sectional view of the washing machine according to a sixteenth preferred embodiment of the present invention, illustrating the main washing space of the washing machine with washing function only and without drying function.

As shown in FIG. 35, optionally, the first main washing space 11*a* or the second main washing space 11*b*, according to the first, fourth, fifth, sixth, seventh, eighth, ninth, tenth, eleventh, twelfth, thirteenth, and fourteenth embodiments, is embodied as an individual washing functional structure without the dehydration, spin-drying or dryer function.

Hereinafter, a washing machine according to a seventeenth embodiment of the present invention is illustrated, wherein those components and configurations having same structure as the above first, second, third, fourth, fifth, sixth, seventh, eighth, ninth, tenth, eleventh, twelfth, thirteenth, fourteenth, and fifteenth preferred embodiment are not repeatedly described in the following.

Figure 36:
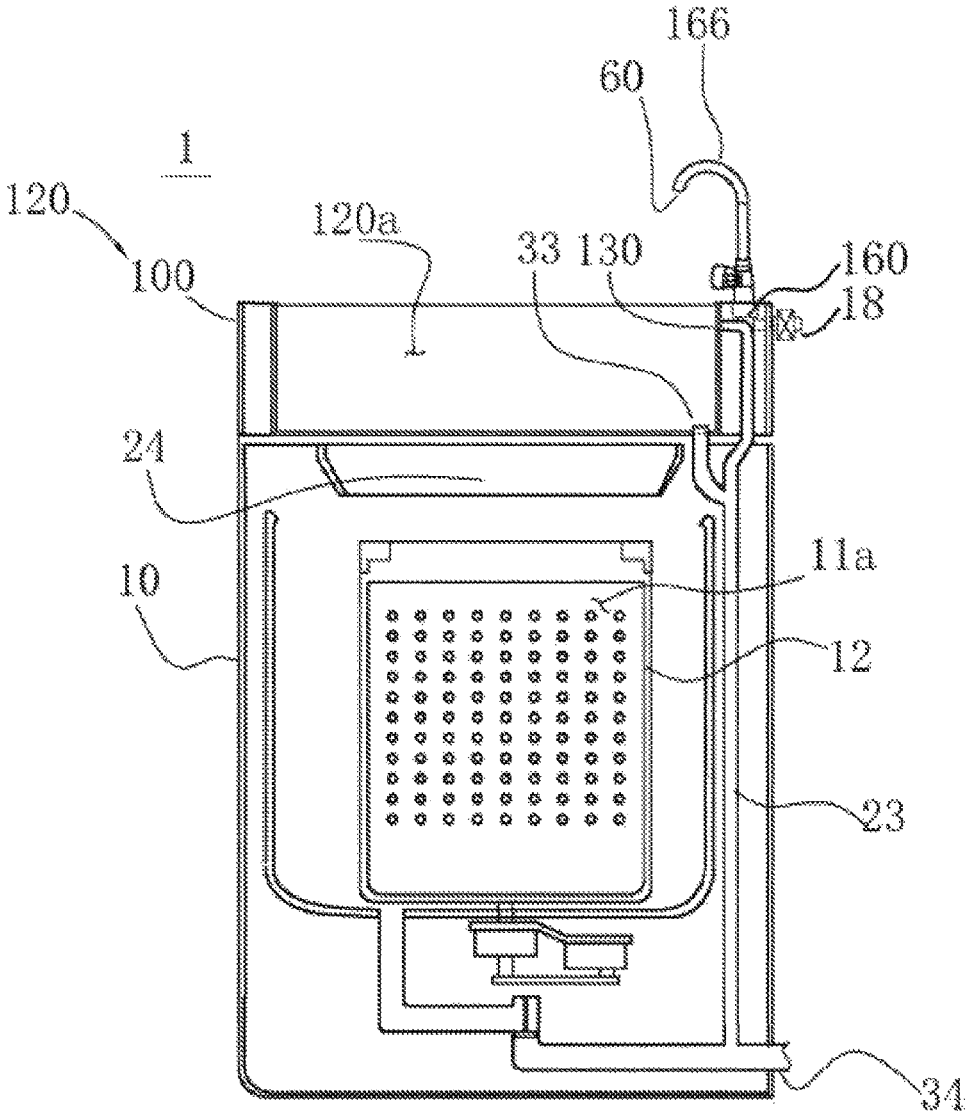
FIG. 36 is a sectional view of the washing machine according to a seventeenth preferred embodiment of the present invention, illustrating the main washing space of the washing machine with drying functional only.

As shown in FIG. 36, optionally, the first main washing space 11*a* or the second main washing space 11*b*, according to the first, fourth, fifth, sixth, seventh, eighth, ninth, tenth, eleventh, twelfth, thirteenth, and fourteenth embodiments, is embodied with a single dehydration, spin-drying, or dryer function of drying laundries without washing function.

Hereinafter, a washing machine according to an eighteenth embodiment of the present invention is illustrated, wherein those components and configurations having same structure as the above preferred embodiment are not repeatedly described in the following.

Figure 37:
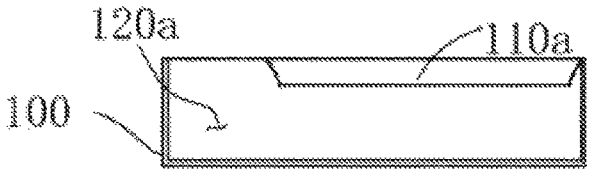
FIGS. 37, 38, 39 and 40 are perspective views of the washing machine with according to an eighteenth preferred embodiment of the present invention, illustrating the doorsets assembly provided with a washboard for washing laundries in different alternative modes.
Figure 38:
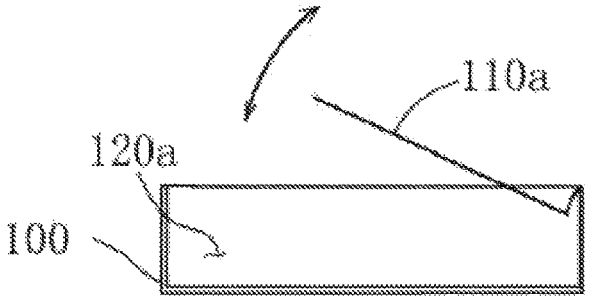
Figure 39:
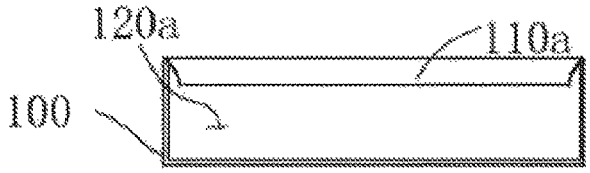
Figure 40:
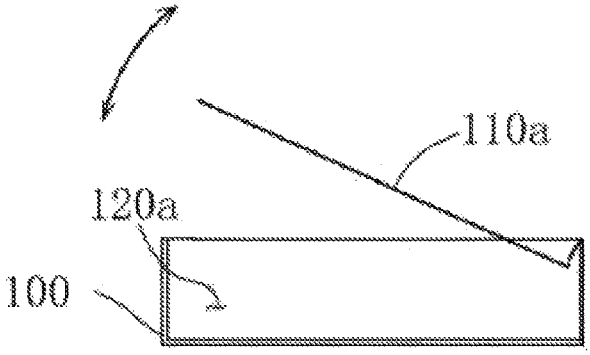

FIGS. 37, 38, 39 and 40 are perspective views of the washing machine with according to an eighteenth preferred embodiment of the present invention, illustrating the washing machine further comprises a washboard 110*a* for washing laundries with different structures. As shown in FIGS. 37 and 39, the washboard 110*a* is placed on doorsets assembly 100. As shown in FIGS. 38 and 40, the washboard 110*a* is hingedly connected to the doorsets assembly 100.

Optionally, as shown in FIG. 37 and FIG. 39, the size of the washboard 110*a* on the doorsets assembly 100 is not configured to cover the space communicating with the auxiliary washing space 120*a* so as to allow the laundries being putted into or taken out of the auxiliary washing space 120*a* below the washboard while washing laundry thereon.

Optionally, the size of the washboard 110*a* on the doorsets assembly 100 may also made to fully cover the auxiliary washing space 120*a* so as to maximize the washing area of the washboard 110*a*.

Optionally, according to the requirement of the user, the washboard 110*a* is hinged with the doorsets assembly 100, wherein the hinge connection position can be set close to a position where the user works and stands. It can also be set at the left side, right side or rear side of the main washing machine body 10.

Optionally, the washboard may comprises one or more friction protrusions (not shown) protruded thereon according to the requirement of the user.

The protruded friction protrusions can promote auxiliary washing during scrubbing. The friction protrusions can be designed to form anywhere on the surface of the washboard. The friction protrusions are used to increase the frictional force with the laundry to be washed during hand washing, so that the dirt and stain thereon are easily washed out from the laundry to be washed. However, the shape and arrangement of the friction protrusions are not limited.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A washing machine with movable auxiliary washing unit, comprising:

a main washing machine body having an opening and a first main washing space communicated with the opening, wherein the main washing machine body comprises a slide unit provided thereon; and an auxiliary washing unit comprising a doorsets assembly slidably connected to the slide unit and configured over the opening, such that the doorsets assembly is slidably movable horizontally between a close position and an open position, wherein in close position, the auxiliary washing unit is positioned above the opening so as to close the opening, and that in the open position, the auxiliary washing unit is able to be driven to slide horizontally away from the opening so as to gradually open the opening, wherein the doorsets assembly further has an auxiliary washing space.

2. The washing machine as recited in claim 1, wherein the doorsets assembly is slidably movable along the slide unit of the main washing machine body so as to be driven in a horizontal direction for opening or closing the opening of the first main washing space.

3. The washing machine, as recited in claim 2, wherein the main washing machine body further comprises a left wing and a right wing adjacent to the doorsets assembly, wherein the slide unit is arranged on the left wing and the right wing such that the doorsets assembly is slidably connected with the slide unit such that the auxiliary washing unit is slidably movable between the left wing and the right wing with respect to the main washing machine so as to open or close the opening.

4. The washing machine, as recited in claim 3, wherein the slide unit comprises a pair of rails mounted between the left wing and the right wing and two sides of the doorsets assembly of the auxiliary washing unit.

5. The washing machine as recited in claim 2, wherein the main washing machine comprises at least one wing on top thereof and the slide unit is arranged on the at least one wing, wherein the doorsets assembly is slidably connected with the slide unit such that the auxiliary washing unit is slidably movable along the at least one wing with respect to the main washing machine so as to open or close the opening.

6. The washing machine as recited in claim 1, wherein the main washing machine body comprises a drain pipe and a drain outlet communicating the first main washing space with outside via the drain pipe, and that the auxiliary washing unit comprises an auxiliary drain outlet being provided at a bottom portion of the auxiliary washing space and communicating with the drain pipe for discharging washing water in the auxiliary washing space to outside.

7. The washing machine as recited in claim 1, 2, 5 or 6, further comprising a sheltering device having an inner cavity to receive the doorsets assembly after being moved thereto for partly or fully hidden therein.

8. The washing machine as recited in claim 7, further comprising a switch control unit connected with the doorsets assembly and arranged on the sheltering device, and a water supply device arranged on the sheltering device.

9. The washing machine as recited in claim 1 or 6, further comprising a first tub providing the first main washing space therein and a second tub providing a second main washing space therein.

10. The washing machine as recited in claim 9, further comprising a second doorsets assembly slidably connected to the slide unit so as to be configured over a second opening of the second tub such that the second doorsets assembly is slidably movable horizontally for opening or closing the opening of the second tub.

11. The washing machine as recited in claim 9, further comprising a second doorsets assembly slidably connected to the slide unit so as to be configured over a second opening of the second tub to be pivotally rotated for opening or closing the opening of the second tub.

12. The washing machine, as recited in claim 1 or 6, wherein the first main washing space is a washing unit having a structure only with washing function.

13. The washing machine, as recited in claim 1 or 6, wherein the first main washing space is a dryer unit having a structure only with dehydration function.

14. The washing machine, as recited in claim 1 or 6, wherein the auxiliary washing unit further comprises a washboard for washing laundries, wherein the washboard is placed on the auxiliary washing space and hinged with the doorsets assembly.

15. The washing machine, as recited in claim 1 or 6, further comprising a locking member, wherein when the auxiliary washing unit is moved away from the opening, the main washing machine body is coupled with the auxiliary washing unit by the locking member.

* * * * *